US010927510B2

(12) United States Patent
Goglia

(10) Patent No.: US 10,927,510 B2
(45) Date of Patent: Feb. 23, 2021

(54) PREFORMED SYNTHETIC TURF GRIDS AND METHODS AND APPARATUSES FOR PROVIDING SAME

(71) Applicant: Gary Keith Goglia, Jupiter, FL (US)

(72) Inventor: Gary Keith Goglia, Jupiter, FL (US)

( * ) Notice: Subject to any disclaimer, the term of this patent is extended or adjusted under 35 U.S.C. 154(b) by 0 days.

(21) Appl. No.: 16/825,844

(22) Filed: Mar. 20, 2020

(65) Prior Publication Data

US 2020/0325640 A1 Oct. 15, 2020

Related U.S. Application Data

(63) Continuation-in-part of application No. 16/379,924, filed on Apr. 10, 2019.

(60) Provisional application No. 62/983,255, filed on Feb. 28, 2020.

(51) Int. Cl.
*E01C 13/08* (2006.01)
*E01C 13/04* (2006.01)

(52) U.S. Cl.
CPC ..... *E01C 13/08* (2013.01); *E01C 13/045* (2013.01)

(58) Field of Classification Search
CPC ..... E01C 13/08; E01C 13/04
See application file for complete search history.

(56) References Cited

U.S. PATENT DOCUMENTS

D811,836 S * 3/2018 Lee ..... D8/14
D894,039 S * 8/2020 Goglia ..... D11/155
2005/0155197 A1* 7/2005 Hunter ..... E04H 13/001 27/30
2009/0181782 A1* 7/2009 Knox ..... A63B 69/3676 473/160

FOREIGN PATENT DOCUMENTS

WO WO-2010120175 A1 * 10/2010 ..... D03D 1/00

OTHER PUBLICATIONS https://www.rhmooreassociates.com/images/pdf/DrivableGrass/Drivable_Grass_Infill_Options19.pdf (printed Sep. 28, 2020).*
https://syntheticgrasswarehouse.com/installing-artificial-grass-between-pavers/ (printed Sep. 28, 2020).*

* cited by examiner

*Primary Examiner* — Kevin R Kruer
(74) *Attorney, Agent, or Firm* — Gronholm Patent Services

(57) ABSTRACT

Pre-cut (or pre-formed) synthetic turf kits and methods of installing same are provided. Kits or methods may or may not include installation templates of paper, foam or other suitable materials with corresponding insert material spaces and patterns printed or already cut out and removed providing a faster and easier install method. The pre-formed turf can be installed either before or after the paver, stone, brick, tile, or wood insert materials are in place to make beautiful square, circle, rectangular and diagonal patterned turf grid designed hardscapes. This makes installation possible without needing an expensive specialty turf contractor.

6 Claims, 19 Drawing Sheets

CONFIGURATION 100

CONFIGURATION 200

CONFIGURATION 200

Pre-Cut Paper Template Laid Down, and Some Inserts in Place

CONFIGURATION 200

Pre-Cut Paper Template Laid Down, and All Inserts in Place

CONFIGURATION 200
(variation with sand atop paper)

Pre-Cut Paper Template Laid Down, Pavers Placed, Sand Layer Atop Paper and Intermediate Pavers, Then Turf Grid (Shown Paritally Installed)

CONFIGURATION 200
Finished Install (with Turf in Place)

CONFIGURATION 300

CONFIGURATION 300

CONFIGURATION 300
Pre-Cut Template Laid Down, All Inserts in Place

CONFIGURATION 300
(or 200)

CONFIGURATION 500

Note: Paper template 520, if used, is similar in shape as that above

PREFORMED SYNTHETIC TURF GRIDS AND METHODS AND APPARATUSES FOR PROVIDING SAME

CROSS REFERENCE TO RELATED APPLICATION

This application is a CIP of and claims the full benefit and priority to U.S. nonprovisional application Ser. No. 16/379,924, filed 2019 Apr. 10, as well as provisional appn No. 62/983,255 filed 2020 Feb. 28.

FIELD

This disclosure generally relates to pathway and patio construction and design.

BACKGROUND

Pathway and patio construction and design is a common task in residential and commercial construction, including the use of, for example, relatively solid elements such as rocks or pavers being situated, attached or detached from a building structure or along a walkway, with grass being situated in between the relatively solid elements. Improvements to such designs are always desirable.

SUMMARY

This summary is intended to introduce a selection of concepts in a simplified form that are further described below in the detailed description section of this disclosure. This summary is not intended to identify key or essential features of the claimed subject matter, and it is also not intended to be used as an aid in isolation to determine the scope of the claimed subject matter.

This inventive disclosure relates to an improved method and apparatus for providing precut (aka pre-formed) synthetic turf kits and methods and apparatuses for providing same, and are an improvement to that shown in U.S. nonprovisional application Ser. No. 16/379,924.

It is a growing trend to have grass or synthetic turf installed in-between and around other surface materials to make synthetic turf and paver, stone, brick, tile, & wood grid patterns for different hardscapes (see Drawings page 1, FIG. 1 & Drawings page 2, FIG. 7). The most common way to accomplish this feature is to start with smaller pieces of solid turf cut from larger rolls. Then, many long and short strips are manually cut to size 'in-the-field' and connected, seamed and all joints are glued in place in-between and around each paver stone, brick, tile, or wood design (square, circle, rectangle, diagonal) making intricate patterns and connections individually one at a time.

It takes a very experienced synthetic turf contractor and is very time consuming and expensive. Currently, synthetic turf is not manufactured or distributed in pre-sized and pre-cut synthetic turf grids. Standard synthetic turf is only available in solid rolls between 12' to 15' wide and usually sold by the length or total square foot in solid pieces (length & width), solid modular strips (DN/20090208674), or solid square tiles (DN/20140286704).

The pre-cut synthetic turf kits are in one version pre-sized and patterned artificial turf/grass grids with paper/foam/or plastic templates and foam or plastic all with the corresponding insert material spaces printed or already cut out and removed creating seamless turf spaces or voids allowing for quicker and easier installation either before or after the paver, stone, brick, tile, or wood insert materials are in place to make beautiful square, circle, rectangular and diagonal patterned turf grid designed hardscapes. This makes installation possible without needing an expensive specialty turf contractor.

Pre-cut synthetic turf grids make complex designs & installation much easier than traditional synthetic turf & installation methods by eliminating all the cutting, seaming, gluing, special tools and training. Pre-cut synthetic turf grids improve installation quality by reducing all the traditional weak points and can shorten labor time from days to hours. Pre-cut synthetic turf grids will allow for a virtually seamless install with no intricate fitting or wasted material due to errant cuts or mistakes made 'in the field'.

Pre-cut synthetic turf grids will be available in a variety of sizes and configurations to be used with the most common size insert shapes and materials (square, circle, rectangle) of pavers, stones, bricks, tiles, and wood tiles available at home improvement stores. Pre-cut synthetic turf grids can be connected to other pre-cut synthetic turf grid pieces to formulate any total grid size area desired. Such kits are easy to connect to make many different desired shapes.

In accordance with another aspect of the present invention is provided a method of assembling a synthetic turf system configured for placement atop a supporting sub-base so as to provide a decorative and functional walking surface, the method comprising the steps of: A) positioning a layer of synthetic turf at a first location; B) while the layer of synthetic turf is positioned at the first location, cutting the synthetic turf layer so as to provide at least two spaced apart voids formed therein, such that a layer of pre-formed turf grid is provided having at least two spaced apart voids defined therein each of which extends completely through the turf grid layer; C) transporting the section of pre-formed turf grid to a second location, the second location being remote from the first location; and D) positioning the section of pre-formed turf grid atop the supporting sub-base, as well as positioning at least two inserts atop the supporting sub-base, such that the two inserts correspondingly fit within the two spaced apart voids within the pre-formed turf grid, and such that the pre-formed turf grid and the two inserts combine to provide the decorative and functional walking surface.

In accordance with another aspect of the present invention is provided a method as described above, wherein the cutting is accomplished by hand.

In accordance with another aspect of the present invention is provided a method as described above, wherein the cutting is accomplished by machine In accordance with another aspect of the present invention is provided a method as described above, wherein the cutting is accomplished by waterjet.

In accordance with another aspect of the present invention is provided a method as described above, wherein in step "D", the pre-formed turf grid is put down on the sub-base before the inserts are put down on the sub-base.

In accordance with another aspect of the present invention is provided a method as described above, wherein in step "D", the inserts are put down on the sub-base before the pre-formed turf grid is put down on the sub-base.

In accordance with another aspect of the present invention is provided a method as described above, wherein in step "D", the inserts include substantially rigid members such as concrete pavers or bricks.

In accordance with another aspect of the present invention is provided a method as described above, wherein in step "B", the voids in the turf grid are regular and repeating.

In accordance with another aspect of the present invention is provided a method as described above, wherein in step "B", the voids in the turf grid are include non-rectangular voids.

In accordance with another aspect of the present invention is provided a method as described above, wherein in step "A", the synthetic turf includes tufted polypropylene.

In accordance with another aspect of the present invention is provided a method as described above, wherein the method is configured for providing two decorative and functional walking surfaces atop two different sub-bases in two different locations, wherein in steps A and B, two separate layers of pre-formed turf grid are provided, namely a first turf grid and a second turf grid, wherein in step C the pre-formed turf grid is the first turf grid; wherein in step D the pre-formed turf grid is the first turf grid, wherein the supporting sub-base is a first supporting sub-base, and wherein the first turf grid and the two inserts combine to provide a first decorative and functional walking surface, and further comprising the following steps: E) transporting the section of the second turf grid to a third location, the third location being remote from the first and second locations and including a second supporting sub-base; and F) positioning the section of the second turf grid atop the second supporting sub-base, as well as positioning at least two inserts atop the second supporting sub-base, such that the two inserts correspondingly fit within the two spaced apart voids within the second turf grid, and such that the second turf grid and the two inserts combine to provide a second decorative and functional walking surface.

In accordance with another aspect of the present invention is provided a method of assembling a synthetic turf system configured for placement atop a supporting sub-base so as to provide a decorative and functional walking surface, the method comprising the steps of: A) positioning a layer of synthetic turf layer at a first location; B) while the layer of synthetic turf is positioned at the first location, cutting the synthetic turf layer so as to provide at least two spaced apart voids formed therein, such that a layer of pre-formed turf grid is provided having at least two spaced apart voids defined therein each of which extends completely through the turf grid layer; C) transporting the section of pre-formed turf grid to a second location, the second location being remote from the first location; D) positioning a section of pre-formed template layer atop the supporting sub-base, the pre-formed template layer including having at least two spaced apart voids defined therein and extending completely through the template layer, the outer peripheries of the two spaced apart voids of the template layer being similar in shape and relative position as the two spaced apart voids of the pre-formed turf grid; E) with the aid of the pre-formed template layer, positioning at least two inserts within the pre-formed template layer such that the outer peripheries of the two inserts correspondingly fit within the two spaced apart voids within the section of the pre-formed template layer, and the two inserts are positioned atop the supporting sub-base; and F) positioning the layer of pre-formed turf grid overlaid atop the pre-formed template layer, such that the two inserts correspondingly fit within the two spaced apart voids within the section of pre-formed turf grid as it is lowered in place, and such that when in place the section of the pre-formed turf grid and the two inserts combine to provide the decorative and functional walking surface.

In accordance with another aspect of the present invention is provided a method as described above wherein the pre-formed turf grid and the pre-formed template layer are both manufactured at the first location, and transported together to the second location.

In accordance with another aspect of the present invention is provided a method as described above wherein the pre-formed template layer is paper.

In accordance with another aspect of the present invention is provided a method as described above wherein the pre-formed template layer is foam.

In accordance with another aspect of the present invention is provided a method of assembling a synthetic turf system configured for placement atop a supporting sub-base so as to provide a decorative and functional walking surface, the method comprising the steps of: A) positioning a layer of synthetic turf layer at a first location; B) while the layer of synthetic turf is positioned at the first location, cutting the synthetic turf layer so as to provide at least two spaced apart voids formed therein, such that a layer of pre-formed turf grid is provided having at least two spaced apart voids defined therein each of which extends completely through the turf grid layer; C) transporting the section of pre-formed turf grid to a second location, the second location being remote from the first location; D) assembling a pre-formed template layer of multiple sections and positioning the assembled template layer atop the supporting sub-base, the pre-formed template layer including having at least two spaced apart voids defined therein and extending completely through the template layer, the outer peripheries of the two spaced apart voids of the template layer being similar in shape and relative position as the two spaced apart voids of the pre-formed turf grid; E) with the aid of the pre-formed template layer, positioning at least two inserts within the pre-formed template layer such that the outer peripheries of the two inserts correspondingly fit within the two spaced apart voids within the section of the pre-formed template layer, and the two inserts are positioned atop the supporting sub-base; and F) positioning the layer of pre-formed turf grid overlaid atop the pre-formed template layer, such that the two inserts correspondingly fit within the two spaced apart voids within the section of pre-formed turf grid as it is lowered in place, and such that when in place the section of the pre-formed turf grid and the two inserts combine to provide the decorative and functional walking surface.

In accordance with another aspect of the present invention is provided a method as described above, wherein step D assembling includes multiple interlocking members.

In accordance with another aspect of the present invention is provided a synthetic turf system configured for placement atop a supporting sub-base so as to provide a decorative and functional walking surface, the turf system comprising: A) a layer of pre-formed turf grid having at least two spaced apart voids defined therein each of which extends completely through the turf grid layer; and B) a template layer positioned atop the supporting sub-base, the template layer including having at least two spaced apart voids defined therein and extending completely through the template layer, the outer peripheries of the two spaced apart voids of the template layer being similar in shape and relative position as the two spaced apart voids of the pre-formed turf grid; and C) two inserts positioned atop the supporting sub-base, the two inserts correspondingly fitting within the two spaced apart voids within the template layer; and D) a layer of pre-formed turf grid positioned atop the supporting sub-base, such that the two inserts correspondingly fit within the two spaced apart voids within the pre-formed turf grid, and such that the pre-formed turf grid and the two inserts combine to provide the decorative and functional walking surface, the outer peripheries of the two spaced apart voids of the template layer being similar in shape and relative position as the two spaced apart voids of the pre-formed turf grid.

In accordance with another aspect of the present invention is provided a system as noted above wherein the pre-formed template layer is paper. In accordance with another aspect of the present invention is provided a system as noted above wherein the pre-formed template layer is foam.

These and other aspects will become readily apparent upon further review of the following specification and drawings. Other objects, features, and advantages of the present invention will become apparent upon reading the following detailed description of the preferred embodiment of the invention when taken in conjunction with the drawing and the appended claims.

DETAILED DESCRIPTION

Introduction

Figure 1:
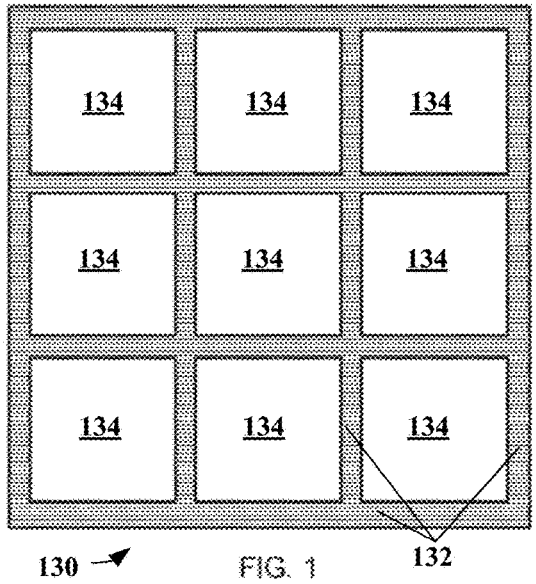
FIG. 1 is a Top Plan View of a pre-cut (aka pre-formed) synthetic turf layer 130 including a body 132 defining voids 134 therein. The pre-cut synthetic turf "grid patterned" body 132 represents what would be the synthetic turf fibers that would replicate the look of grass. The voids 134 represent the cut-out square turf spaces or voids 134 with no turf and where the other material inserts (paver, stone, brick, tile, or wood tile) would be placed.

The present invention now will be described more fully hereinafter with reference to the accompanying drawings, in which some, but not all embodiments of the inventions are shown. This invention may be embodied in many different forms and should not be construed as limited to the embodiments set forth herein; rather, these embodiments are provided so that this disclosure will satisfy applicable legal requirements. Like numbers refer to like elements throughout.

The invention consists of a new pre-cut synthetic turf grid design applique process used in the manufacturing of synthetic turf. This new finishing process allows for easier installation and integration with other materials for synthetic turf walkways, patios, pool surrounds, driveways, walls, & fences, considered 'hardscapes', for the synthetic turf industry, building & landscape design industry, & DIY industry.

It is a growing trend to have grass or synthetic turf installed in-between and around other surface materials to make synthetic turf and paver, stone, brick, tile, & wood grid patterns for different hardscapes. The most common way to accomplish this feature is to start with smaller pieces of solid turf cut from larger rolls. Then, many long and short strips are manually cut to size 'in-the-field' and connected, seamed and all joints are glued in place in-between and around each paver stone, brick, tile, or wood design (square, circle, rectangle, diagonal) making intricate patterns and connections individually one at a time.

It takes a very experienced synthetic turf contractor and is very time consuming and expensive. Currently, synthetic turf is not manufactured or distributed in pre-cut synthetic turf grids. Standard synthetic turf is only available in solid rolls between 12' to 15' wide and usually sold by the length or total square foot in solid pieces (length & width), solid modular strips (DN/20090208674), or solid square tiles (DN/20140286704).

Reference is now made to the figures, in which like elements indicate like elements throughout the several views.

ELEMENT LIST

Here is a list of the various elements:

- 100 First Configuration
  - 130 Pre-Cut Synthetic Turf Layer (aka pre-formed turf grid)
    - 132 body
    - 134 voids
  - 140 Inserts
- 200 Second Configuration
  - 220 Paper Template (aka pre-formed template layer)
    - 222 body
    - 224 voids
  - 230 Pre-Cut Synthetic Turf Layer (aka pre-formed turf grid)
    - 232 body
    - 234 voids
  - 240 Inserts
- 300 Third Configuration
  - 320 Pre-Cut Foam Template (aka pre-formed template layer)
  - 330 Pre-Cut Synthetic Turf Layer (aka pre-formed turf grid)
    - 332 body
    - 334 voids
  - 340 Inserts
- 400 Fourth Configuration
  - 420 Interlocking Foam or PVC Template
- 500 Free-Form Configuration
  - 520 Pre-Cut Foam Template (aka Template)
  - 530 Pre-Cut Synthetic Turf Layer
  - 540 Pre-cut of Pre-Formed Inserts

DISCUSSION

As will be seen, there are multiple embodiments of the present inventions. Each of these resulting installed embodiments may be achieved by at least one corresponding installation method. These are as follows:

Pre-cut synthetic turf grids are used in architectural and landscape designs for hardscapes most commonly used to make grass and paver, stone, brick, tile, or wood patterned walkways, patios, driveways, walls and fence installations.

Traditional synthetic turf is currently only manufactured and distributed in solid rolls between 12' to 15' wide and usually sold by the length or total square foot. It is typically sold and installed by specialty turf contractors and there are usually large minimums of square footage required for a professional installation job. Any special designs or patterns including walkway grids with lots of additional cutting and seaming labor is an additional premium charge and only attempted by highly experienced experts.

Figure 4:
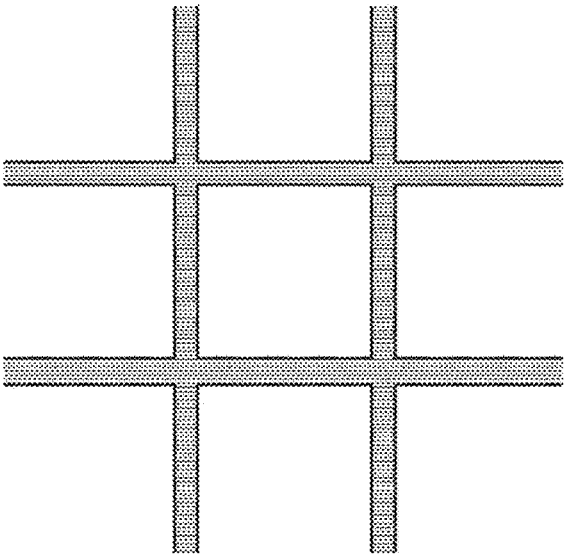
FIG. 4 is a Top Plan View which is same as FIG. 1 except this example does not have the turf border around the perimeter.
Figure 7:
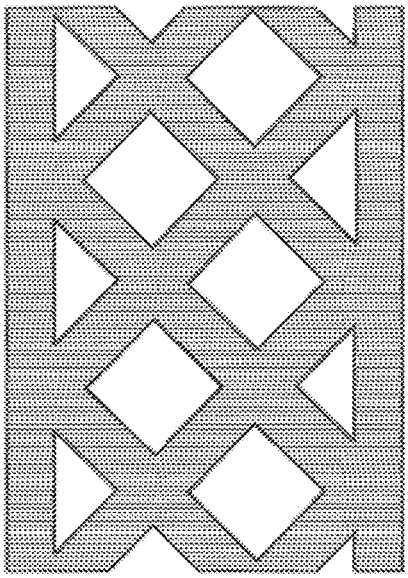
FIG. 7 is a Top Plan View of pre-cut synthetic turf grid diagonal pattern with boarder. The white diagonal squares represent the cut-out turf spaces or voids with no turf and where the other material inserts (paver, stone, brick, tile, or wood tile) would be placed. All the boarder lines represent the grid border design and the shaded horizontal line pattern represents what would be the synthetic turf fibers that would replicate the look of grass.

Pre-cut synthetic turf grids eliminate all the complicated cutting, fitting, seaming, & gluing in-the-field of traditional synthetic turf designs by manufacturing and distributing an already pre-sized, patterned, & factory pre-cut by hand or machine synthetic turf grid kit product (See Drawings FIGS. 1,4 & 7).

Figure 2:
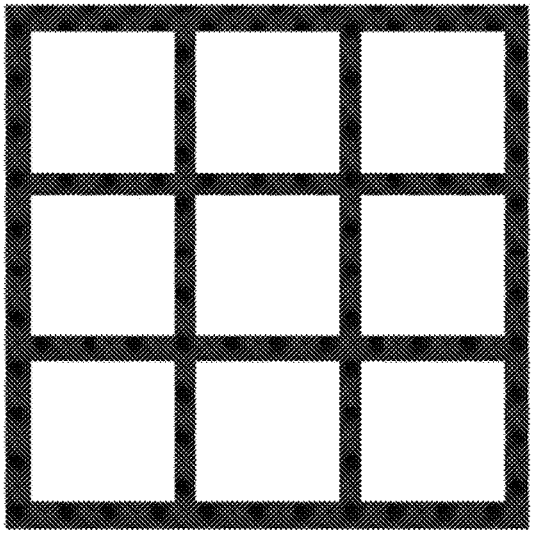
FIG. 2 is a Bottom Plan View which is comprised of a polypropylene backing that the turf fibers are tufted into forming many rows.
Figure 5:
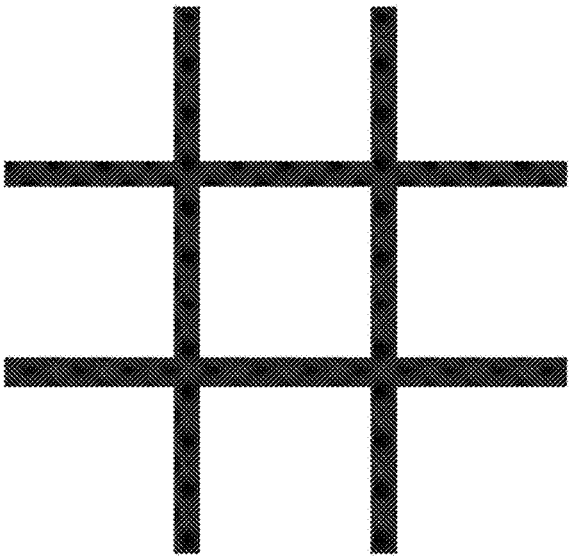
FIG. 5 is a Bottom Plan View, same as FIG. 2 except this example does not have the turf grid border around the perimeter.
Figure 6:
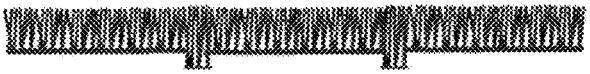
FIG. 6 is a Left Side Elevation View, Right Side Elevation View, Top Side Elevation View, & Bottom Side Elevation View, which are all Identical and represent the synthetic turf fibers or pile height usually between 1 inch to 3 inches tall.
Figure 8:
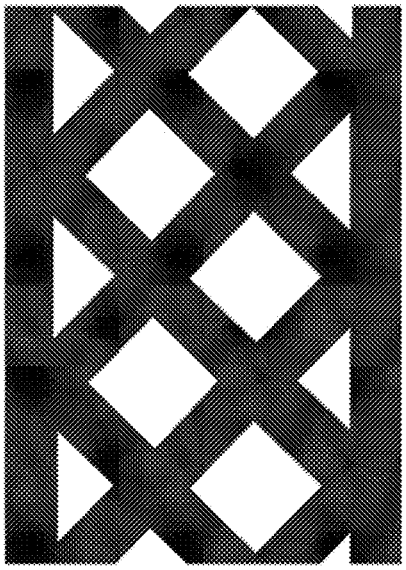
FIG. 8 is a Bottom Plan View of the diagonal pattern with boarder which is comprised of a polypropylene backing that the turf fibers are tufted into forming many rows.
Figure 9:
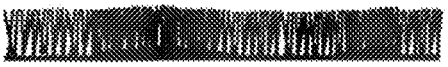
FIG. 9 is a Top Side Elevation View & Bottom Side Elevation View which are all Identical and represent the synthetic turf fibers or pile height usually between 1 inch to 3 inches tall.
Figure 10:
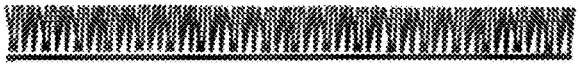
FIG. 10 is a Left Side Elevation View & Right Side Elevation View which are all Identical and represent the synthetic turf fibers or pile height usually between 1 inch to 3 inches tall.
Figure 11:
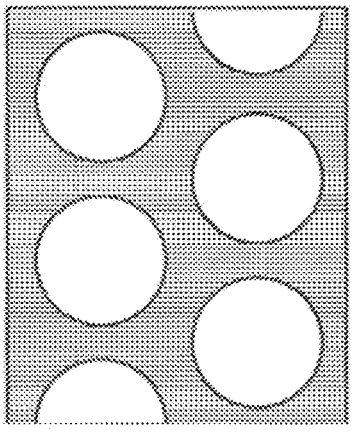
FIG. 11 is a Top Plan View of pre-cut synthetic turf circle pattern. The white circles represent the cut-out turf spaces or voids with no turf and where the other material inserts (paver, stone, brick, tile, or wood tile) would be placed. All the border lines represent the border design and the shaded horizontal line pattern represents what would be the synthetic turf fibers that would replicate the look of grass.
Figure 12:
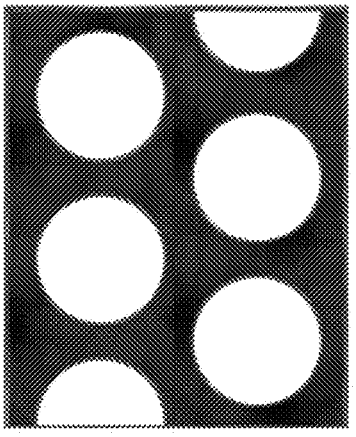
FIG. 12 is a Bottom Plan View which is comprised of a polypropylene backing that the turf fibers are tufted into forming many rows.
Figure 13:
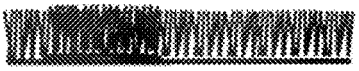
FIG. 13 is a Top Side Elevation View, & Bottom Side Elevation View, which are all Identical and represent the synthetic turf fibers or pile height usually between 1 inch to 3 inches tall.
Figure 14:
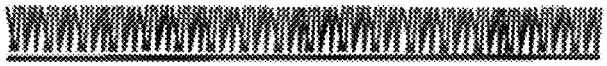
FIG. 14 is a Left Side Elevation View & Right Side Elevation View which are all Identical and represent the synthetic turf fibers or pile height usually between 1 inch to 3 inches tall.
Figure 15:
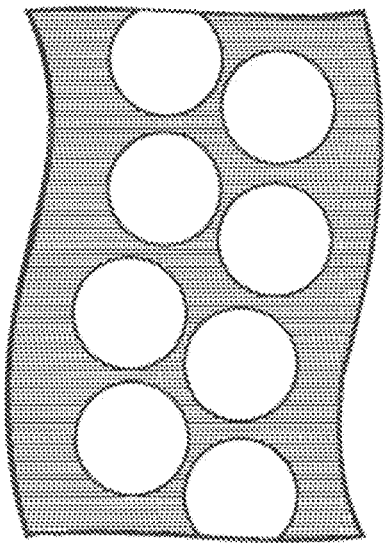
FIG. 15 is a Top Plan View of pre-cut synthetic turf freeform circle pattern. The white circles represent the cut-out turf spaces or voids with no turf and where the other material inserts (paver, stone, brick, tile, or wood tile) would be placed. All the border lines represent the border design and the shaded horizontal line pattern represents what would be the synthetic turf fibers that would replicate the look of grass.
Figure 16:
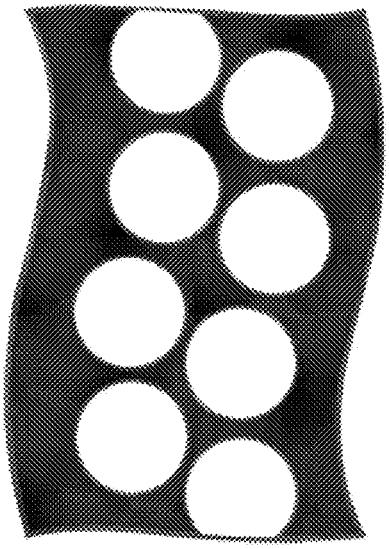
FIG. 16 is a Bottom Plan View which is comprised of a polypropylene backing that the turf fibers are tufted into forming many rows.
Figure 17:
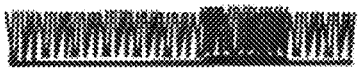
FIG. 17 is Top Side Elevation View, & Bottom Side Elevation View, which are all Identical and represent the synthetic turf fibers or pile height usually between 1 inch to 3 inches tall.
Figure 18:
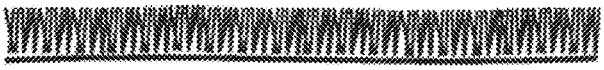
FIG. 18 is a Left Side Elevation View & Right Side Elevation View which are all Identical and represent the synthetic turf fibers or pile height usually between 1 inch to 3 inches tall.

Pre-cut synthetic turf grids are made using a standard piece of synthetic turf finished goods. Pre-cut pieces of synthetic turf grids can be manufactured from a traditional 12' or 15' wide standard size roll, either in place on the roll or by cutting smaller sections from the standard roll. When cutting by hand, either on the roll, or a smaller piece section, the desired working length or piece size of the turf material is rolled out onto floor or work table with the underside, usually comprised of a polypropylene backing, facing up. Next, the square, circle, rectangle or diagonal shape grid pattern design template made from wood, plastic or metal and sized accordingly per a standard specification is applied to the turf backing or underside (See Drawings FIGS. 2,5 & 8 for finished product underside). Then each pattern shape is manually cut out and removed by hand following the template with a carpet cutting tool creating a pattern of turf spaces or voids.

If using a CNC machine, the standard roll of turf or section of turf piece size is loaded onto the bed or platform of the CNC machine and the specific design template CAD file would be initiated and used to drive the CNC machine and the grid pattern would be cut automatically (CNC knives, water jetting, or laser cutting machine). When pre-cut by machine using a CAD file, the final design can be more intricate and easily modified per specification or need (See Drawings FIG. 1 showing design with border & FIG. 4 showing design without boarder). The excess synthetic turf pieces are removed by hand or machine creating a pattern of turf spaces or voids, then turf is folded or rolled by hand or machine and packaged accordingly for distribution or sale.

Figure 3:
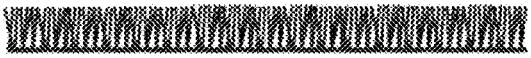
FIG. 3 is a Left Side Elevation View, Right Side Elevation View, Top Side Elevation View, & Bottom Side Elevation View, which are all identical and represent the synthetic turf fibers or pile height usually between 1 inch to 3 inches tall.

The pre-cut synthetic turf grids allow a DIYer or any type of contractor to install for example; a beautifully designed & complex walkway by simply rolling out or unfolding the pre-cut synthetic turf grid on top of an already properly prepared sub-base and finished by installing the corresponding sized paver, stone, brick, tile, or wood pieces in the already cut out turf spaces or voids to form the finished product. Depending on the desired finished aesthetic and application, the final turf height (See Drawings FIG. 3) may need to be adjusted, secured and infill added by standard synthetic turf installation methods not being claimed.

One aspect of the invention includes synthetic turf kits manufactured & distributed with pre-cut (square, circle, rectangle, & diagonal) grid pattern shapes cut out by hand or machine creating a pattern of turf spaces or voids for use with matching or corresponding paver, stone, brick, tile, wood, & composite materials that are designed to be installed on ground or flat/vertical wall surfaces to make decorative and functional hardscapes.

Said another way, one aspect of the invention modifies synthetic turf in its traditional solid roll turf form for distribution and sale by adding a manual or machine design cutting process to change the overall look and shape of the finished turf material offering a new and improved method of design and application allowing seamless integration and use with other materials for hardscape installations.

First Configuration

Reference is now made to FIGS. 1-19, which show a configuration which may be referenced as a "first" configuration 100, which includes the following elements:

130 Pre-Cut Synthetic Turf Layer

- 132 body
- 134 voids

140 Inserts

Figure 19:
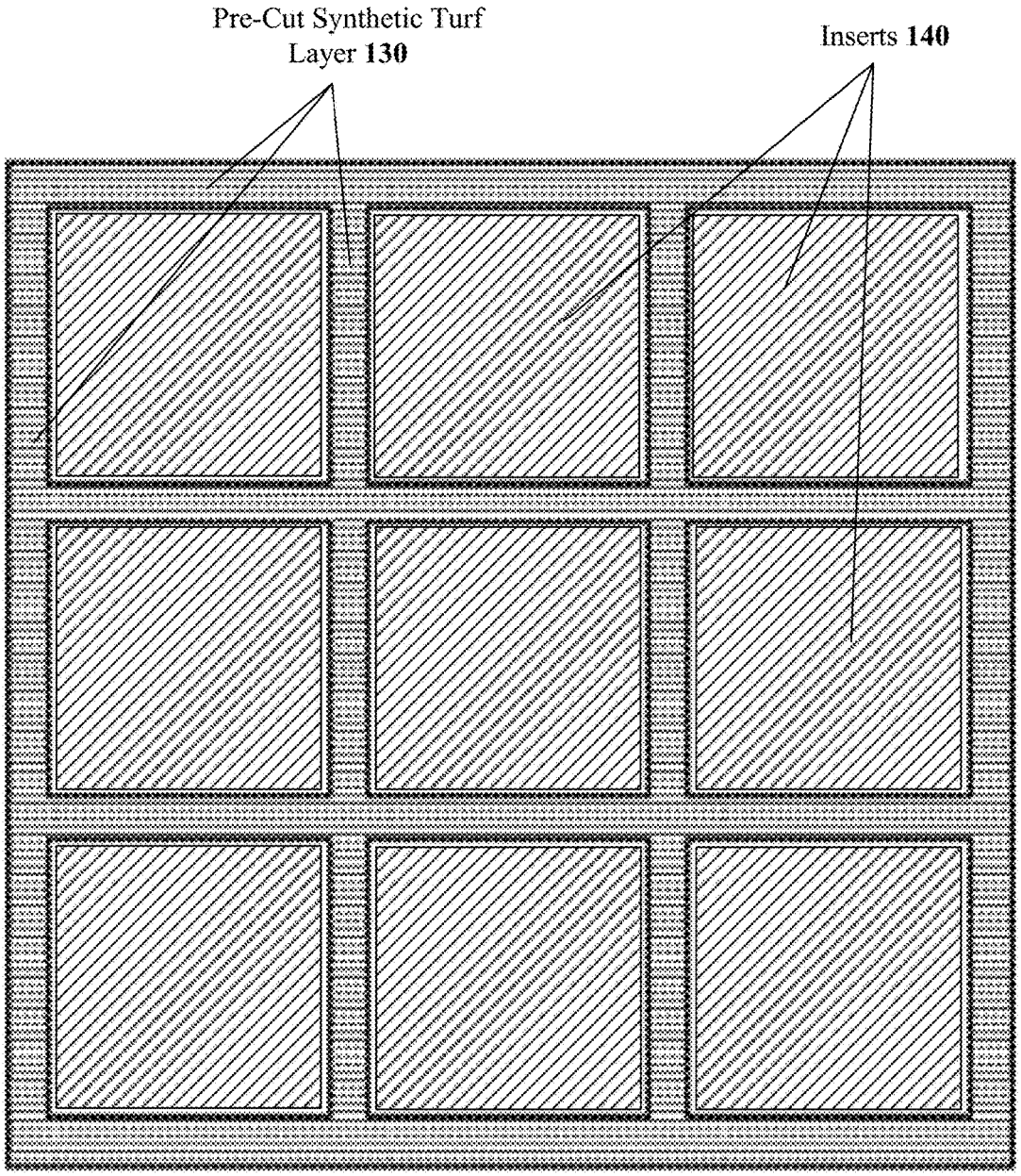
FIG. 19 shows an installed configuration 100, consisting of a pre-cut synthetic turf layer 130 and inserts 140 positioned in place.

The turf layer 130 and inserts are shown in FIG. 19; the body 132 and voids 134 are shown in FIG. 1. The turf layer 130 may also be referenced as a "pre-formed turf grid".

The turf layer 130 is "pre-cut" at a first location and then distributed to a second location, that being the installation location. In the pre-cut stage, various grid pattern shapes (square, circle, rectangle, & diagonal) are cut out by hand or machine (e.g., by waterjet) at the first location, creating a predetermined pattern of turf spaces or voids for later use with corresponding inserts such as pavers, stone, bricks, tile, wood, & composite materials that are designed to be installed, at a second location, on ground or flat/vertical wall surfaces to make decorative and functional hardscapes, with the system configured for placement atop a supporting sub-base, so that the synthetic turf system simulates a walkway, a patio or fastened to a vertical wall or fence to create a finished surface.

The walkway or patio comprises a turf layer 130 configured to be manipulated into an uninstalled form such as by rolling or folding and which is also configured to be manipulated into an installed form such as by unrolling or unfolding when in said placement atop said supporting surface.

The turf layer itself (before cutting) in one configuration comprises a simulated turf product such as known in the art, which includes an elongate substantially planar backing layer having an upper side and a lower side, the lower side configured for placement atop the supporting sub-base; and a plurality of elongate turf fibers, wherein each of the elongate turf fibers has one end attached proximate the elongate substantially planar backing layer, and each fiber also has a free end extending from the upper side of the elongate substantially planar backing layer, such that the elongate turf fibers extend in a generally coparallel manner such that they and the elongate substantially planar backing layer combine to simulate the elongate turf layer.

The turf layer 130 after being cut defines a plurality of cut-out voids extending completely through the elongate turf layer, which were predetermined in shape before they were delivered to the second location, being the installation location.

Finally, at the second location, a plurality of inserts 140 are each placed into a corresponding one of the plurality of cut-out voids and atop the supporting sub-base, such that the turf layer combines with the plurality of inserts 140 to provide a finished product simulating an elongate walkway or open patio.

Second Configuration 200

A second configuration is also contemplated under the present invention, which includes an additional element, namely a paper template. This second configuration is installed using a corresponding second installation method.

The second configuration 200 includes the following elements:

220 Pre-Cut Paper Template (aka pre-formed template layer)

230 Pre-Cut Synthetic Turf Layer

240 Inserts

Reference is made generally to FIGS. 20-26 for explanation of this second configuration 200. It could be said that this includes its own method of installation, as well as its own kit for providing such a method of installation.

Figure 20:
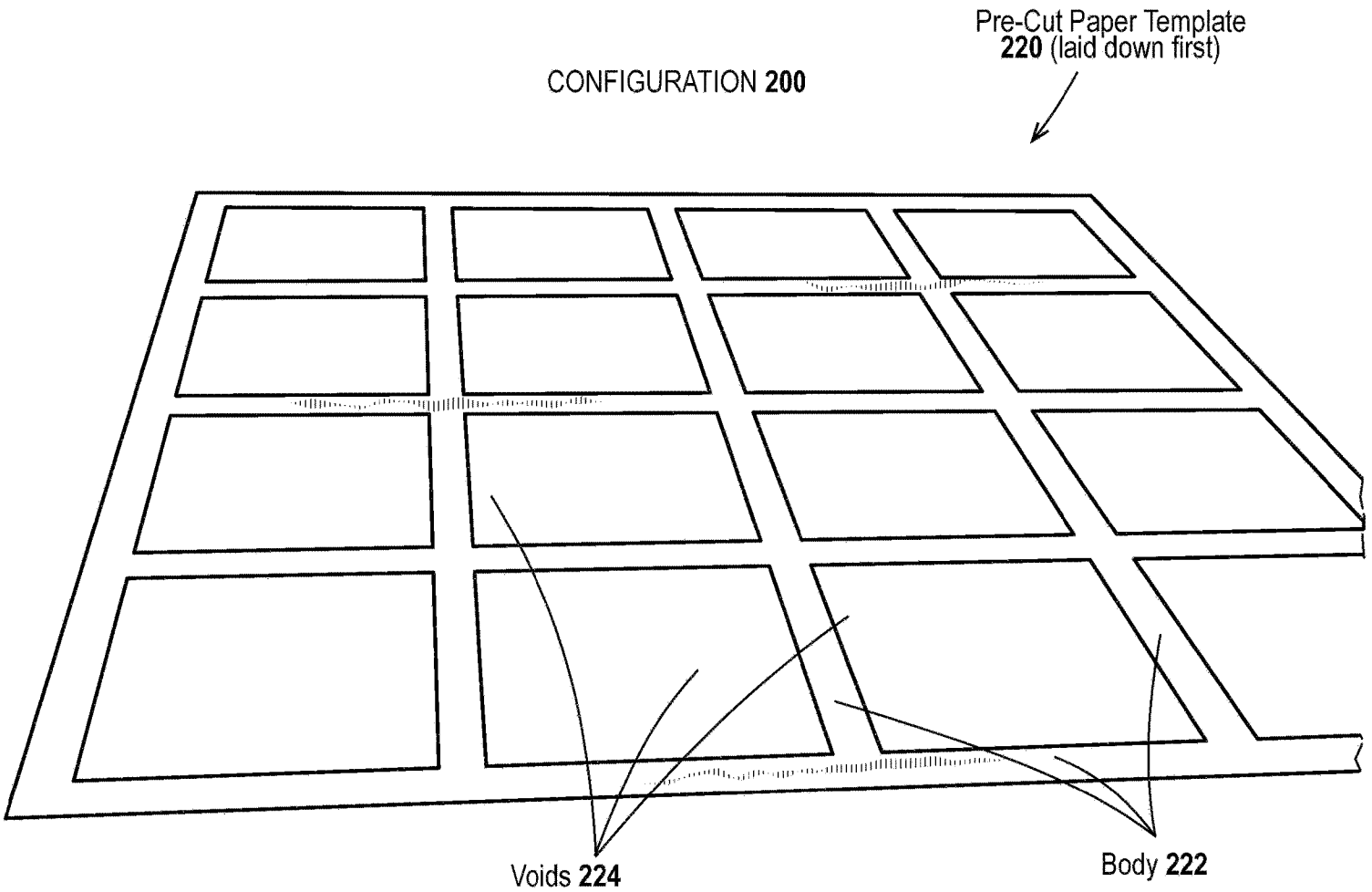
FIG. 20 shows a pre-formed paper template 220 laid down on a suitable supporting surface (including but not limited to dirt, sand, gravel, concrete, etc.) as would be used in a corresponding installation process discussed elsewhere in this application, which in brief includes the initial remote production of a paper template with spaced apart voids and a pre-formed turf layer (in this case in a grid pattern) with matching corresponding spaced apart voids, installation on site of a pre-formed paper template with spaced apart voids, subsequent installation of items on-site such as pavers in the voids, and finally the on-site installation of the pre-cut turf layer with matching spaced apart voids.
Figure 21:
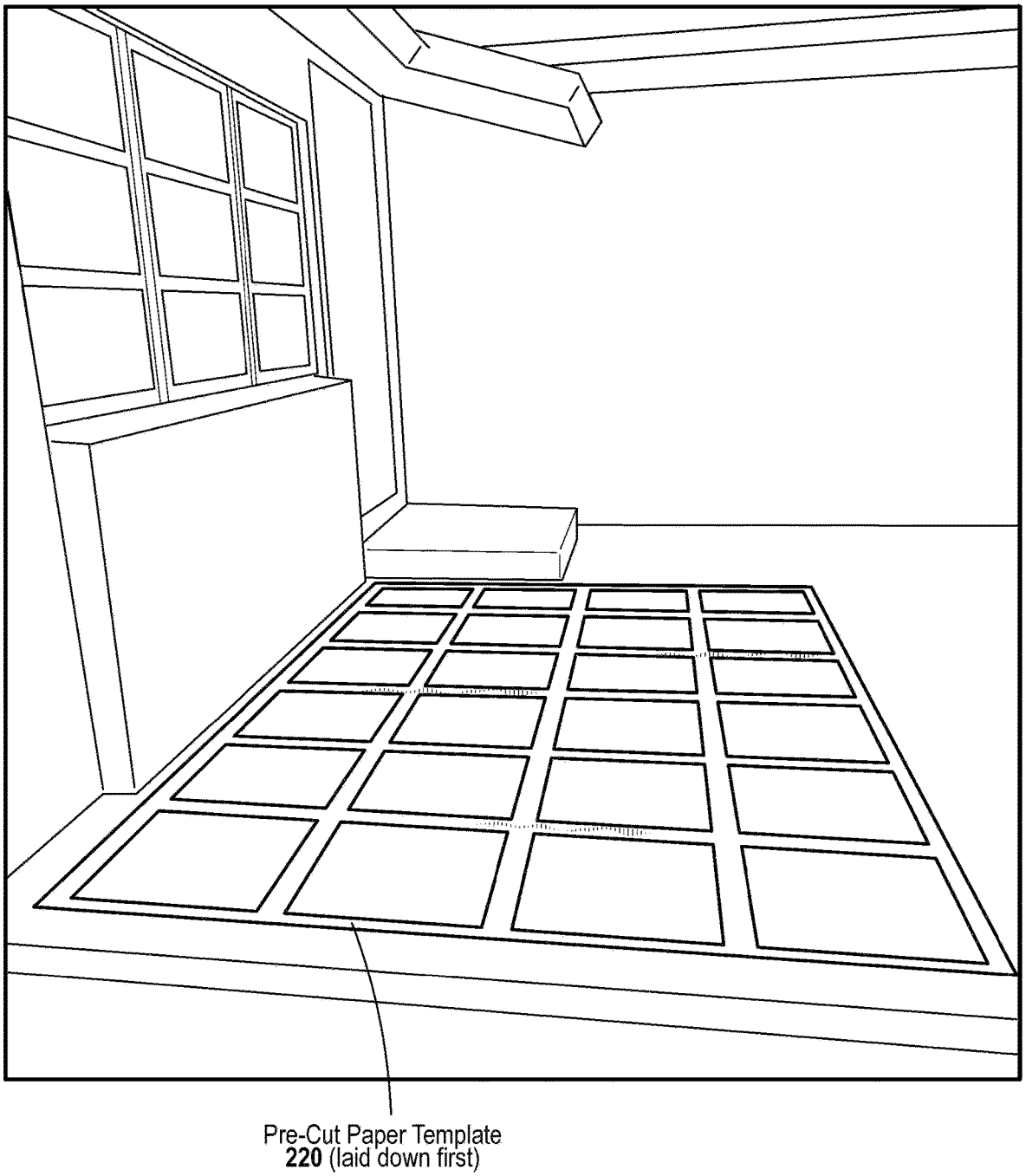
FIG. 21 is another view of the paper template 220 laid down on a suitable supporting surface.
Figure 22:
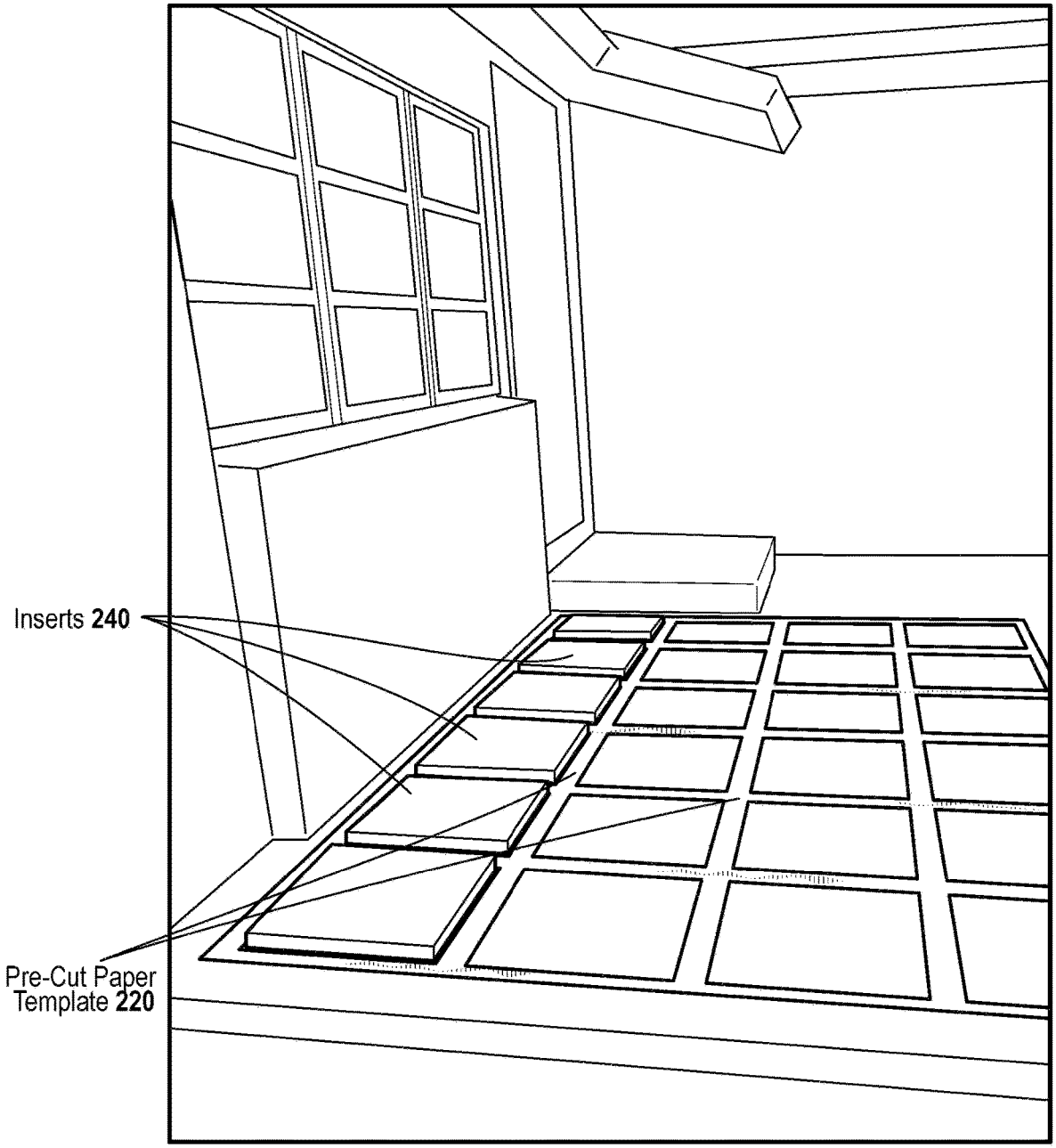
FIG. 22 shows the paper template laid down on a suitable supporting surface, along with several, but not all, inserts such as pavers installed, as would be used in an installation process discussed elsewhere in this application.
Figure 23:
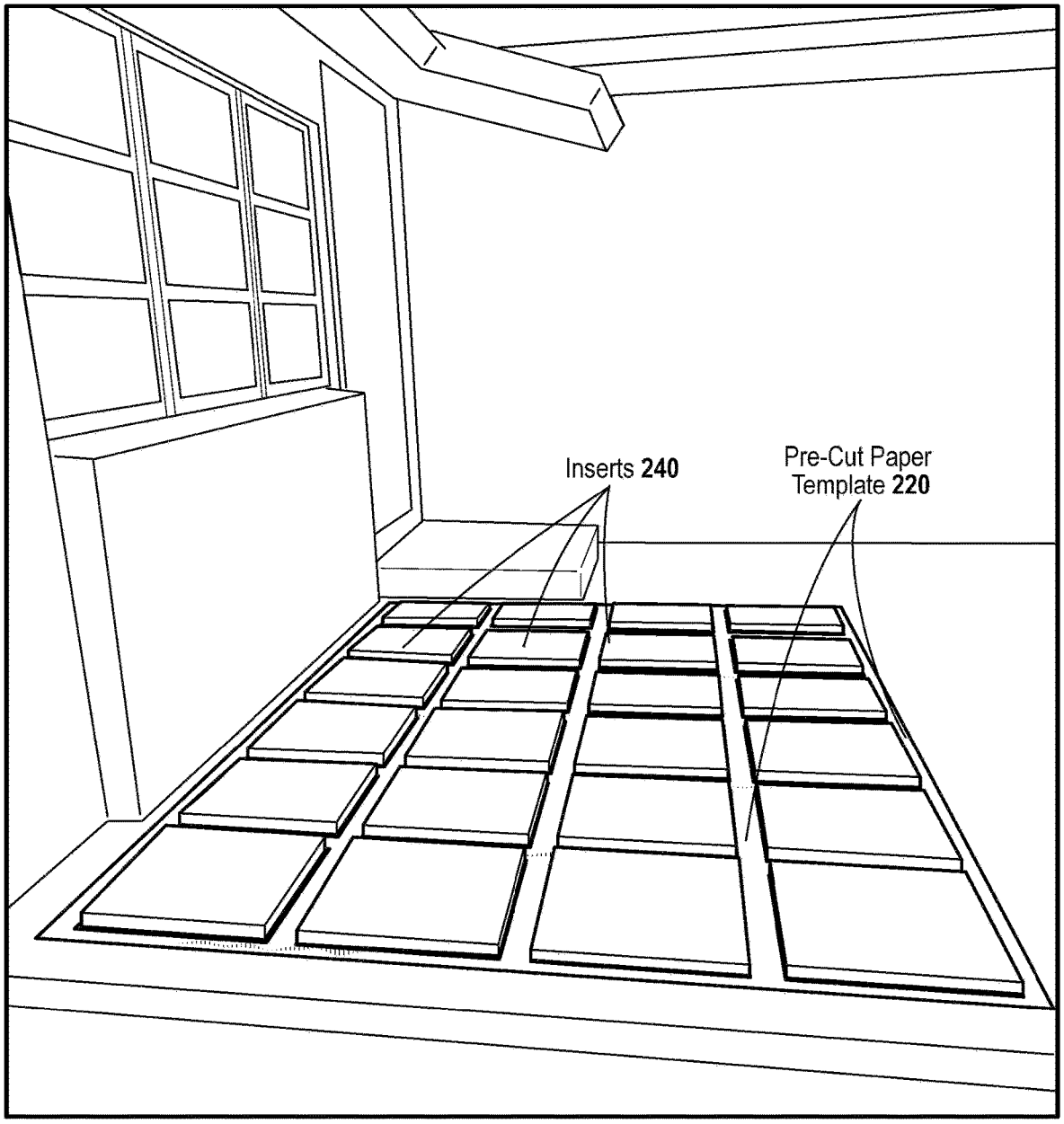
FIG. 23 shows the paper template 220 laid down on a suitable supporting surface, along with all inserts 240 (such as in the figure, pavers) installed.
Figure 24:
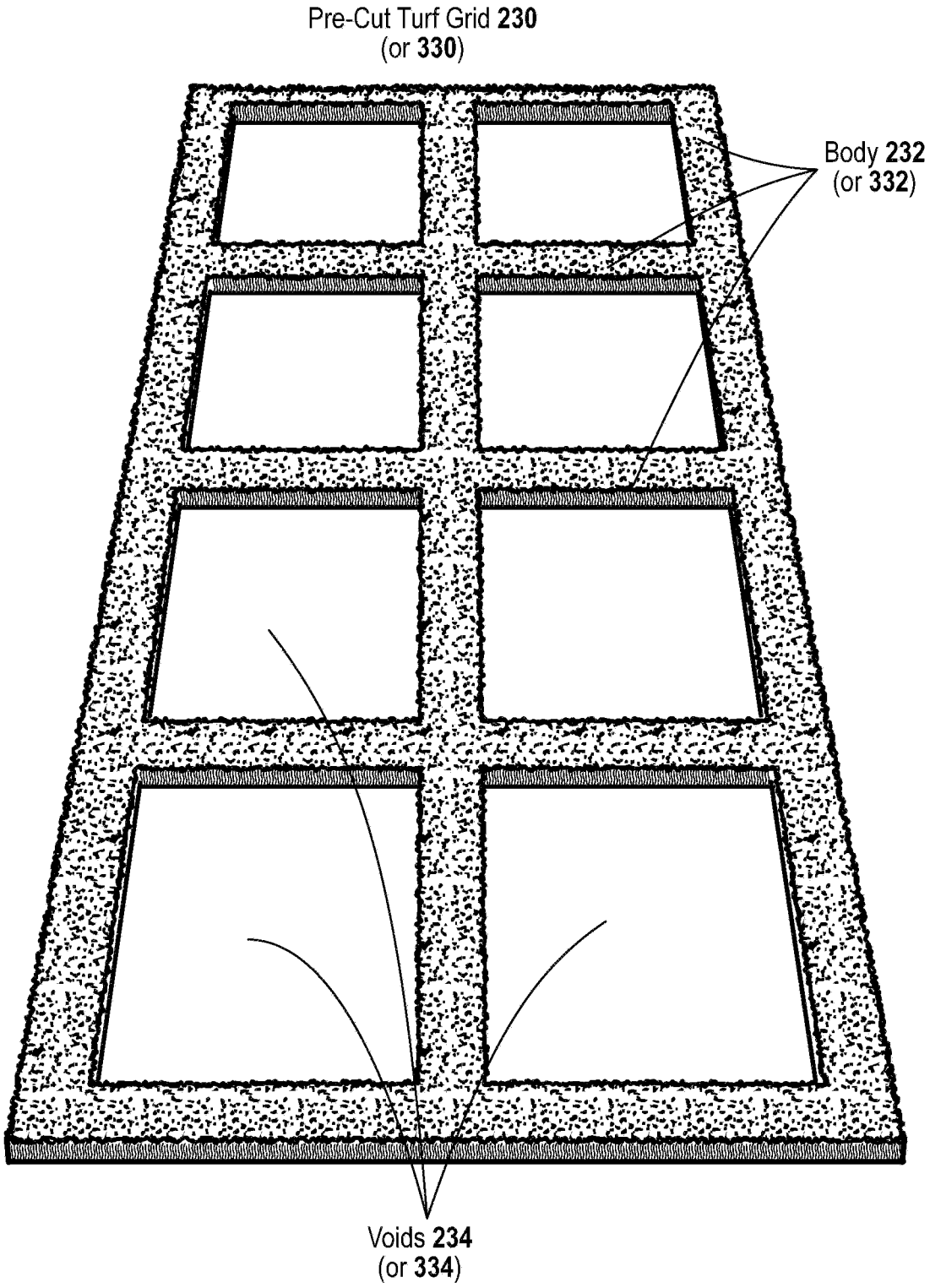
FIG. 24 shows a pre-cut turf layer in isolation. This layer could be the grid configuration 230 used in configuration 200, or the grid configuration 330 used in configuration 300.
Figure 25:
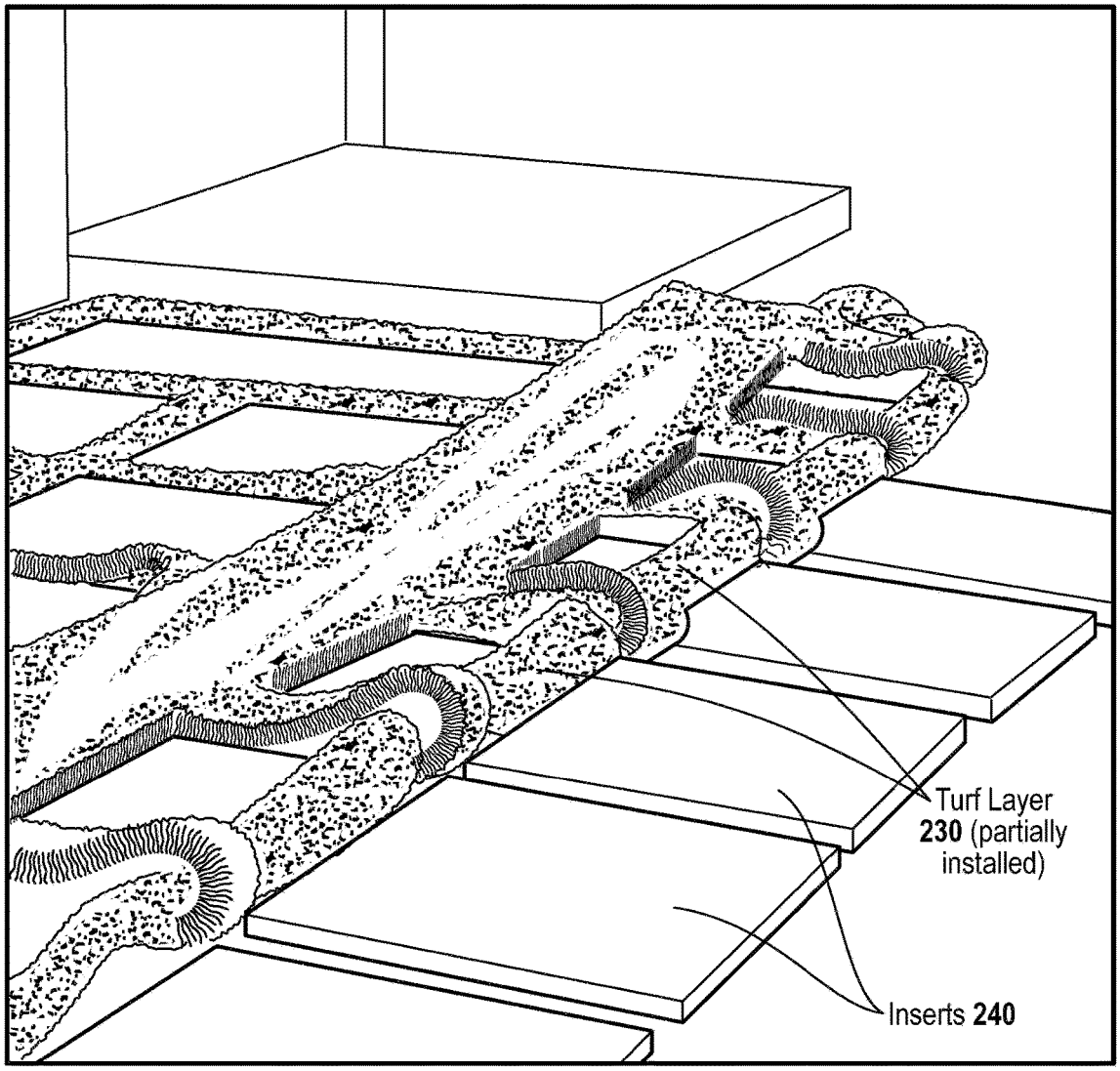
FIG. 25 shows a pre-cut paper template laid down (not visible due to being covered with sand), inserts 240 (pavers) in placed, a sand layer applied atop the pre-cut paper template and intermediate the pavers, then a turf grid shown partially installed.

Under this second configuration, a pre-formed paper template 220 is first laid down such as shown in FIGS. 20 and 21, atop a suitable supporting surface (including but not limited to dirt, sand, gravel, concrete, etc.).

As may be seen, the Pre-Formed Paper Template 220 includes a body 222 which defines a plurality of prints, perforations or voids 224 therein which are shaped to match the intended inserts 240. This paper template 220 is grid-like in nature, in that it defines a plurality of rectangular (or square) prints, perforations or voids which are regularly spaced in a grid pattern. Similarly, the Pre-Formed Synthetic Turf Layer 230 includes a body 232 which defines a plurality of voids 234 therein which are shaped to match the intended inserts 240. This layer is likewise in the form of a grid. It may be understood that the insert grid pattern could be simply printed on the paper template (inserts placed on top of template and in the printed space, no cutting), or the grid pattern could be in perforated form on the template (so it could be removed on-site or left in place) and finally it could be cut out as shown in for example FIG. 21. All of these three features can be easily created with a pattern plotter/cutter machine.

The method of assembling the second configuration is as follows.

First, at least one of the Pre-Formed Paper Template 220 and the Pre-Cut Synthetic Turf Layer 230 are created at a first location such as a manufacturing facility. Under one configuration, a "kit" is provided for sale, which includes the Pre-Formed Paper Template 220 and the Pre-Cut Synthetic Turf Layer 230 in the kit, along with instructions for subsequent second location (aka on-site) installation with matching, fitting, inserts, as described elsewhere. Under another configuration, the "kit" also includes the inserts.

Once the Pre-Formed Paper Template 220 and the Pre-Cut Synthetic Turf Layer 230 are moved to the second location, the Pre-Formed Paper Template 220 is placed atop a substantially level supporting surface (of base material such as bare dirt, sand, crushed concrete, screenings, concrete, or combination of, etc.). As noted, the Pre-Formed Paper Template 220 includes a body 222 which defines a plurality of voids 224 therein which are shaped to match the intended inserts. This provides a guide for placement of the inserts 240, such as bricks, wood blocks, pavers, hard plastic elements, or the like).

The Inserts 240 are then placed within the predetermined voids 224, if cut, or atop the printed pattern if only printed and not cut.

At this point, sand or other filler may be optionally placed upon the paper template body 222, in order to raise the surface upon which the Turf Layer 230 will be placed, and to position the turf layer and the inserts at desired relative heights.

Figure 26:
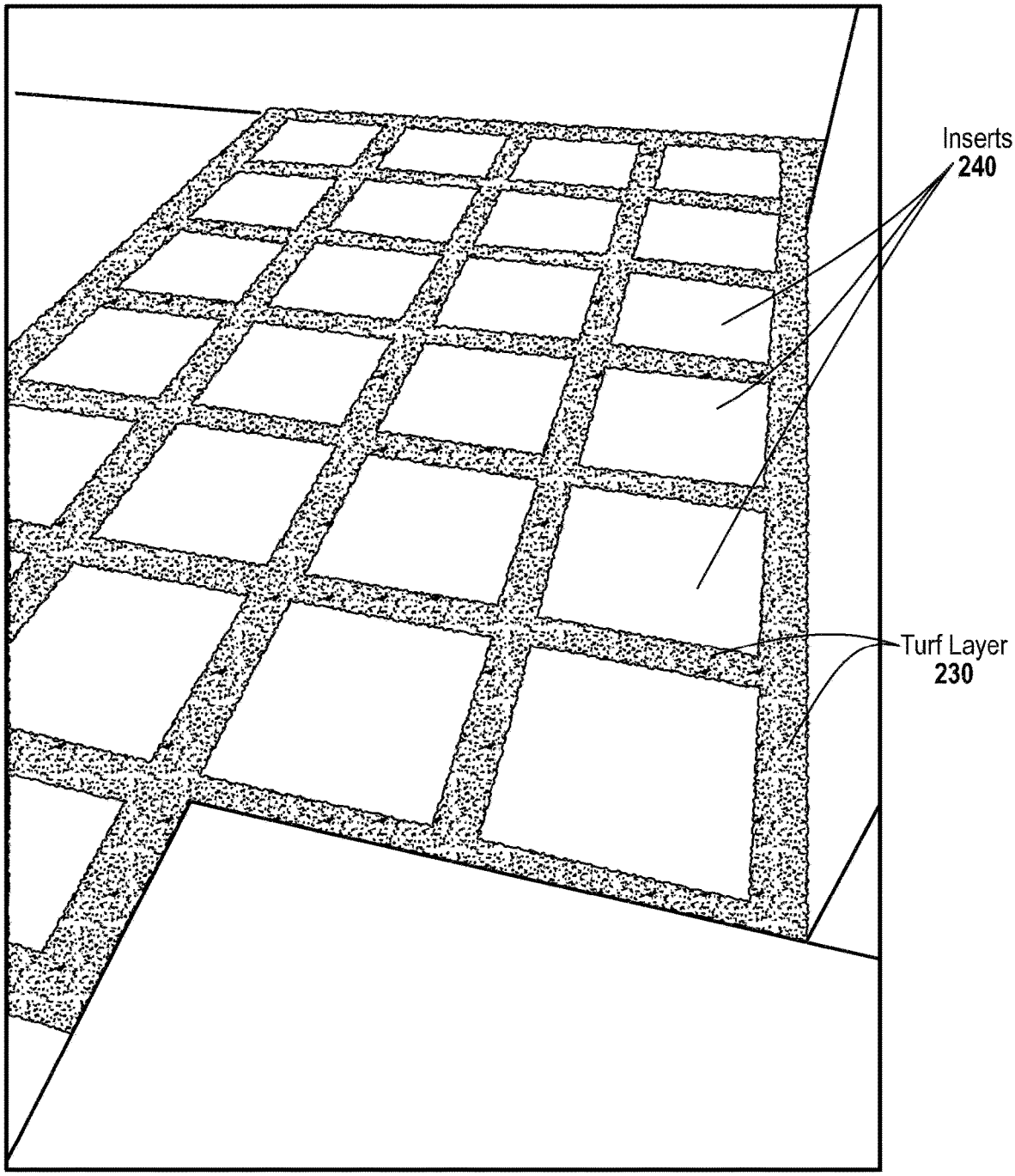
FIG. 26 shows a finished install of the configuration 200, with the turf in place.
Figure 27:
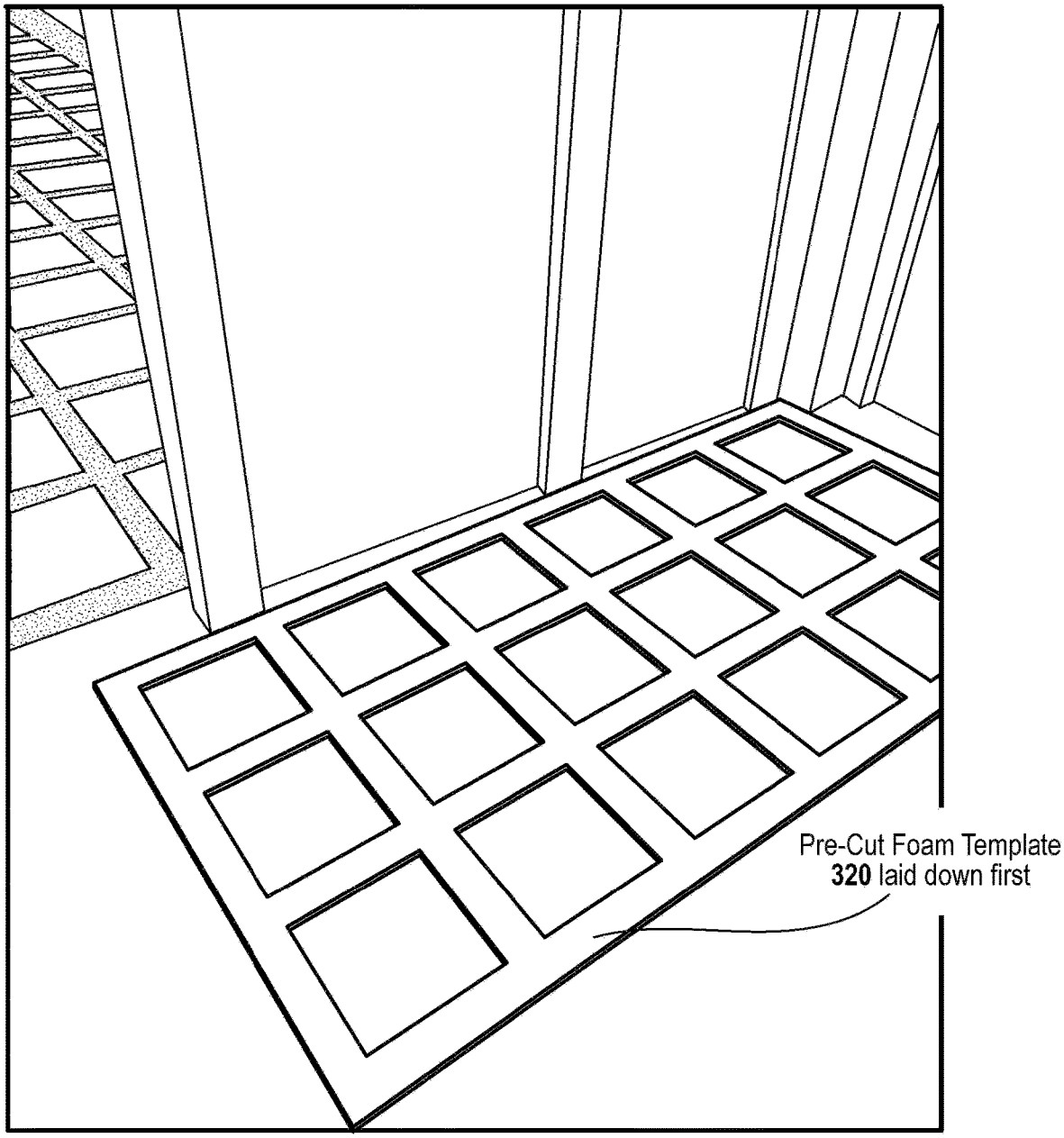
FIG. 27 shows a pre-cut foam template in isolation, laying atop a supporting surface for purposes of viewing. This configuration is used by an installation process discussed elsewhere in this application, which in brief included the initial remote production of a pre-cut foam template with spaced apart voids and a pre-cut turf layer with spaced apart voids, installation on site of the pre-cut foam template with spaced apart voids, subsequent installation of items on-site such as pavers in the voids, and finally the on-site installation of the pre-cut turf layer with spaced apart voids.
Figure 28:
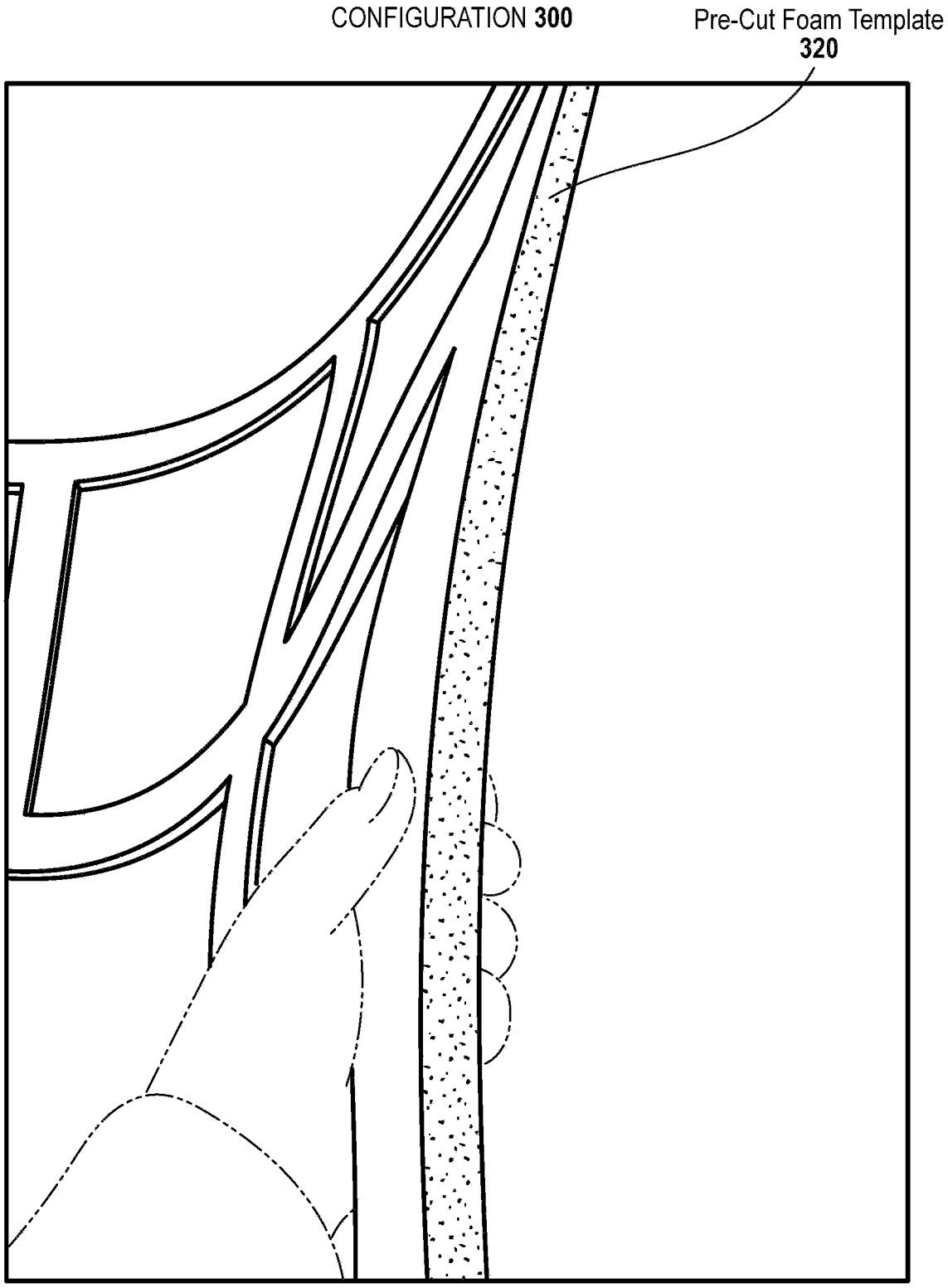
FIG. 28 shows a more detailed view of the pre-cut foam template 320 being held in the hand of a user.
Figure 29:
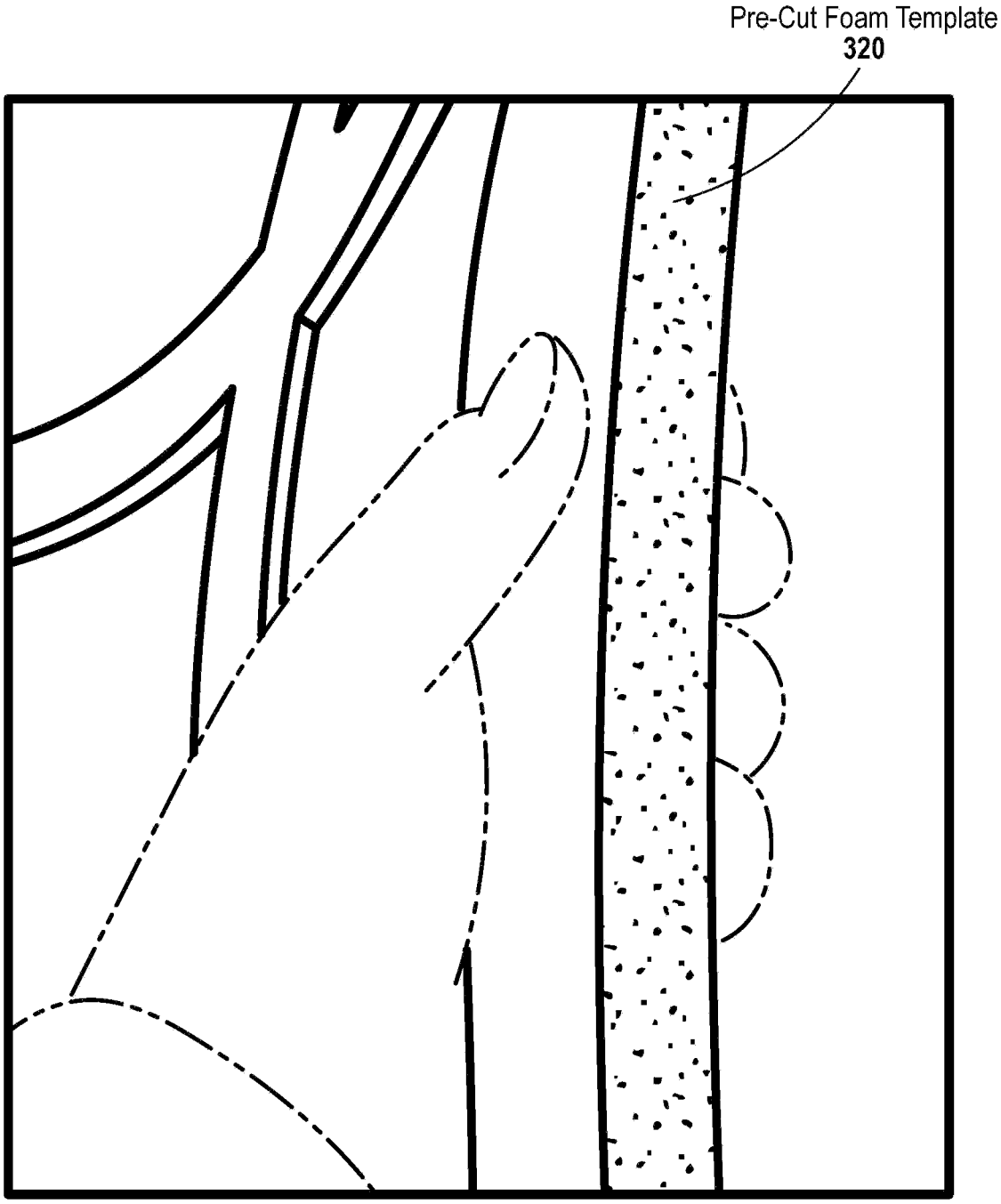
FIG. 29 shows a shows an even more detailed view of the pre-cut foam template 320 being held in the hand of a user.
Figure 30:
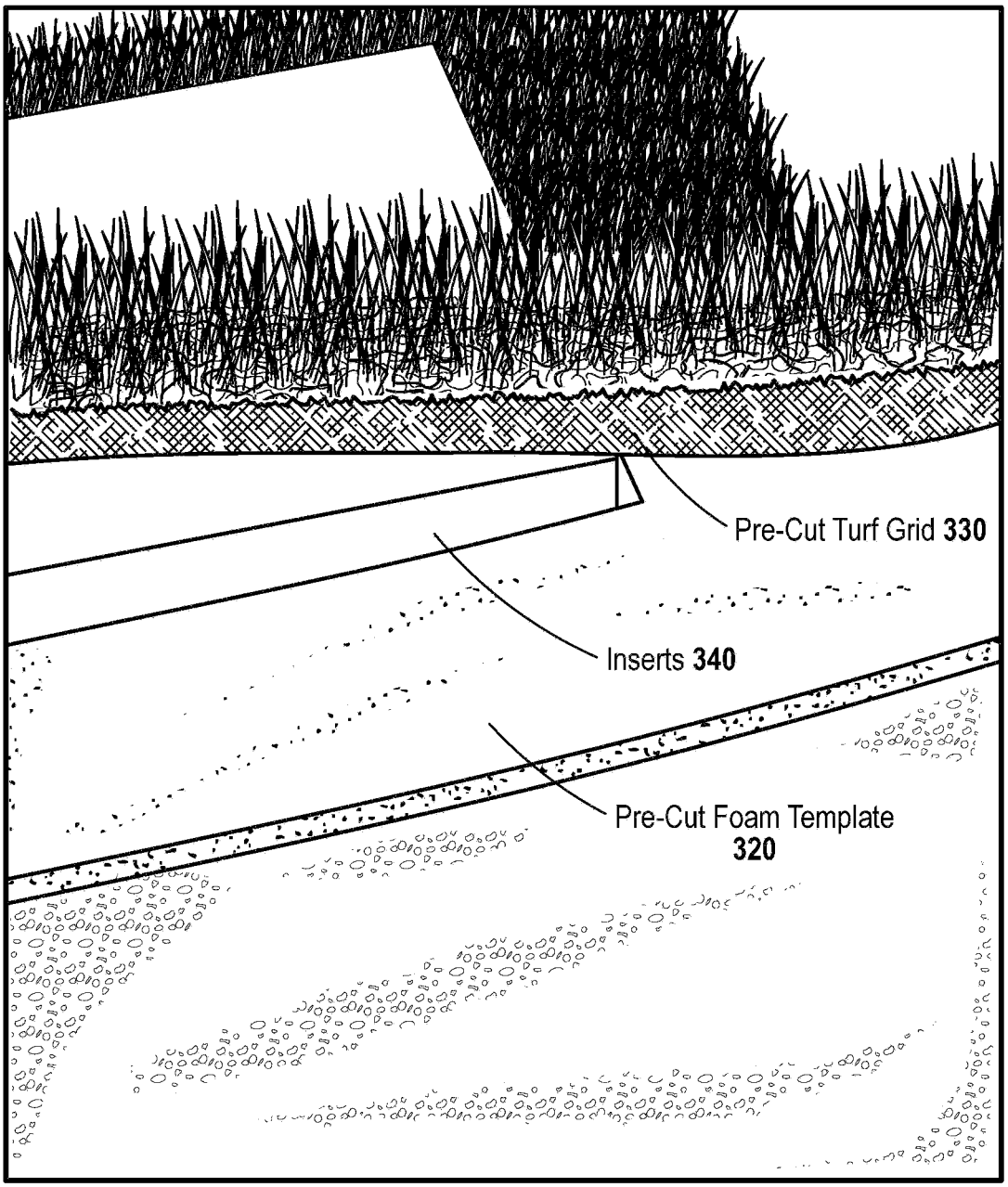
FIG. 30 shows a pre-cut foam template laid down on a supporting surface, with inserts shown in place, and the turf grid being peeled up slightly from its installed position for more detailed viewing. This configuration is provided by a Method B installation process discussed elsewhere in this application.

The Pre-Cut Turf Layer 230 is then placed in position such as shown in FIG. 26, such that the inserts fit within the voids of the turf Layer.

Use of the Paper Pre-Formed Template 220 makes installation easier and quicker than original configuration with little or no cost to the consumer. This template can be paper, cardboard, or the like, and can be biodegradable.

Third Configuration 300

A third configuration is also contemplated under the present invention, which includes a foam template instead of a paper template, and it could be sold as a "premium" product.

Reference is made to FIGS. 27-30 for explanation of this third configuration 300. It could be said that this includes its own method of installation, as well as its own kit for providing such a method of installation.

Under this third configuration, a pre-cut foam template 320 is first laid down instead of a paper template.

The third configuration 300 includes the following elements:

320 Pre-Cut Foam Template-(aka pre-formed template layer)

330 Pre-Cut Synthetic Turf Layer

340 Inserts

The Pre-Cut Foam Template-320 could be of a synthetic or other foam type filler material (or alternately could be made from cork, bamboo or some other natural material). The Template-320 can be of varying thickness, density/weight, including but not limited to 0.5" to 1.0" thick. It may have grooves or connecting points on the edges or sides to link together additional sections in order to accommodate larger areas.

As may be seen, the Pre-Cut Foam Template 320 defines a plurality of voids 334 therein which are shaped to match the intended inserts. Similarly, the Pre-Cut Synthetic Turf Layer 330 includes a body 332 which defines a plurality of voids 334 therein which are shaped to match the intended inserts.

The method of assembling the third configuration is as follows.

First, at least one of the Pre-Cut Foam Template 320 and the Pre-Cut Synthetic Turf Layer 330 are created at a first location such as a manufacturing facility. Under one configuration, a "kit" is provided for sale, which includes the Pre-Cut Foam Template 320 and the Pre-Cut Synthetic Turf Layer 330 in the kit, along with instructions for subsequent second location (aka on-site) installation with matching, fitting, inserts, as described elsewhere. Under another configuration, the "kit" also includes the inserts.

Once the Pre-Cut Foam Template 320 and the Pre-Cut Synthetic Turf Layer 330 are moved to the second location, the Pre-Cut Foam Template 320 is placed atop a substantially level supporting surface (of base material such as bare dirt, sand, crushed concrete, screenings, concrete, or combination of said materials). As may be seen, the Pre-Cut Foam Template 320 defines a plurality of voids therein which are shaped to match the intended inserts. This provides a guide for placement of the inserts 340, such as bricks, wood blocks, pavers, hard plastic elements, or the like).

The Inserts 340 are then placed within the predetermined voids 334 defined by the template 320.

Figure 31:
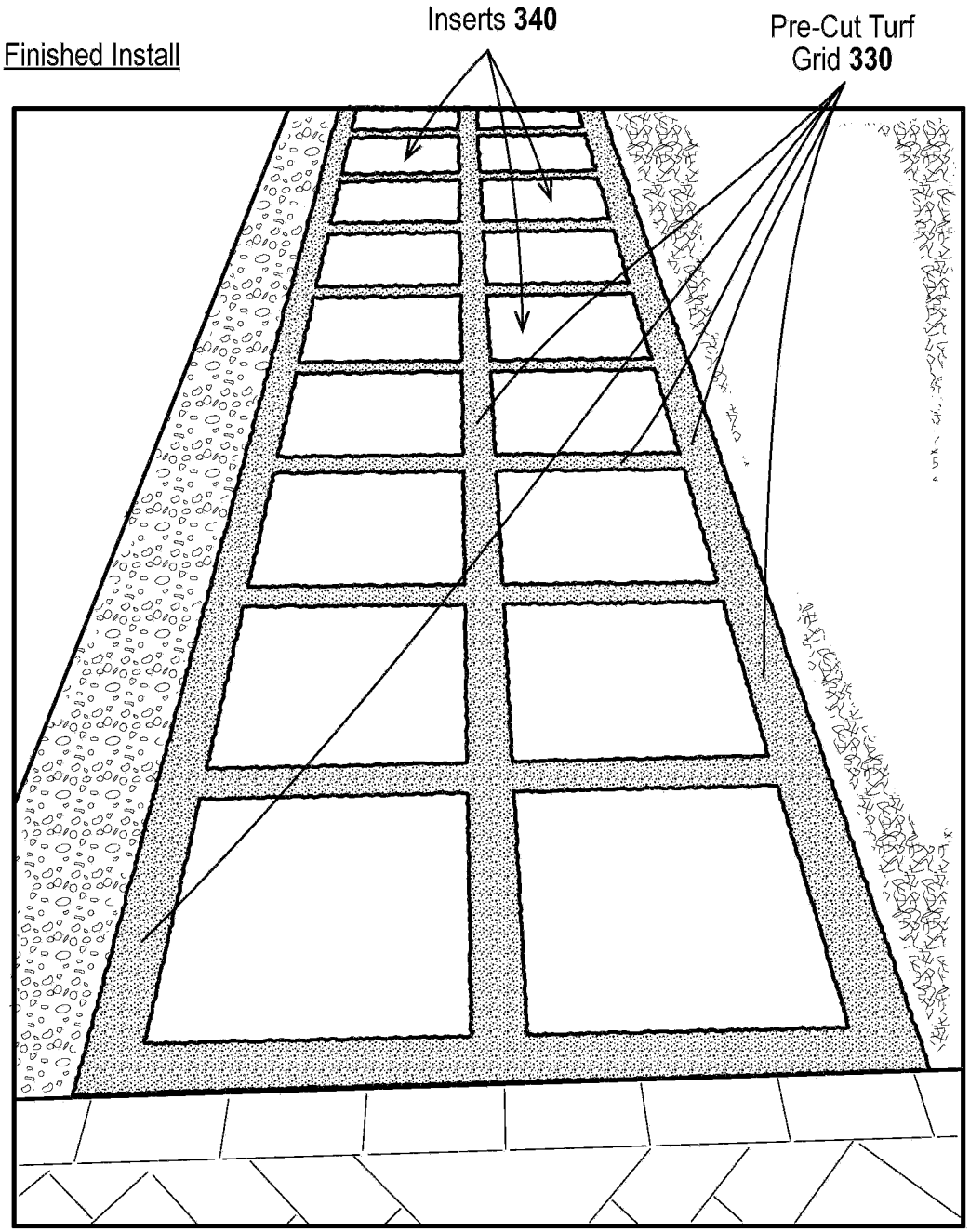
FIG. 31 shows a finished configuration 300 provided by an installation process discussed elsewhere in this application.

The Pre-Cut Turf Layer 330 is then placed in position such as shown in FIG. 31, such that the inserts fit within the voids of the turf grid.

Configuration 400

Figure 32:
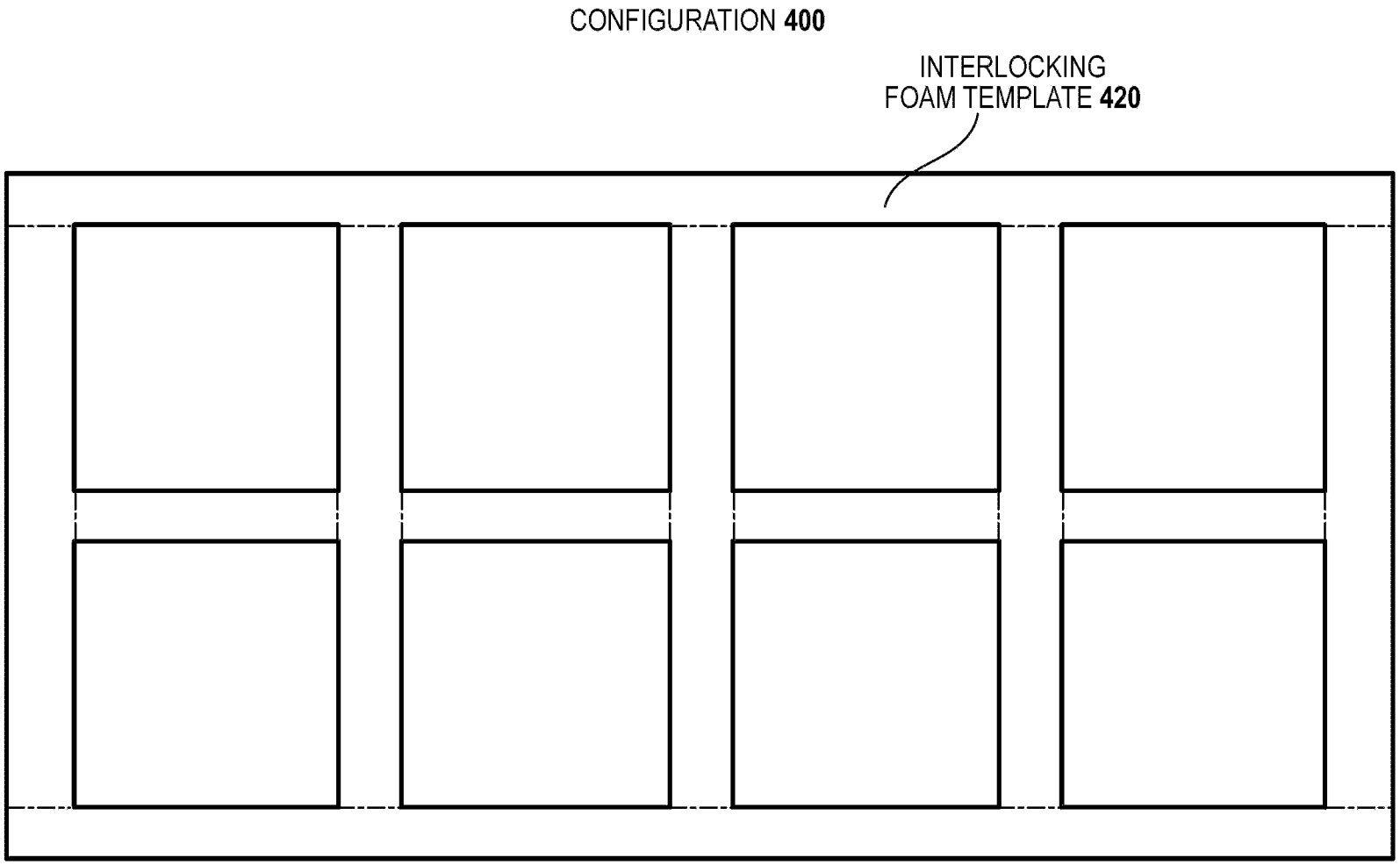
FIG. 32 shows a graphic illustration of a configuration 400 using a foam or PVC template, which uses an interlocking foam or pvc piece construction configuration of under one aspect of the present invention.

Also contemplated is the substitution of snap or interlocking plastic/PVC pre-formed strips for the foam template. Reference is made to FIG. 32, which shows foam template 420 (or alternate plastic template which could be substituted for the foam template) which is in 13 pieces, and is provided with suitable interlocking capabilities at the dotted line locations in order to allow the installer to assemble the configuration onsite much like a puzzle. This could have advantages in that such a configuration is not necessarily limited to a given length of grid.

Free-Form Configuration 500

Installing turf in-between natural or irregular shaped stones or pavers in the shape of an elongated walkway or patio space is extremely challenging, time consuming, and expensive, putting it totally out of reach for the average consumer or DIYer. It often requires multiple contractors, including a Paver Contractor, and a team of Professional Turf Installers and lots of tedious labor. All the materials must be sourced separately, installed randomly and then finished all on-site and in-the-field. It is not replicable or standardized. The present invention contemplates pre-cut turf and stone "free-form" kit eliminating all the hassle allowing a DIYer to install a high end and desirable walkway having a "free-form" appearance or patio space without the need to hire a professional paver company or synthetic turf company to complete.

The free-form kit configuration 500 eliminates all the weak points of a traditional install of this type of complexity. It is consistent and repeatable. This eliminates all the expert stone layout, turf fitting, cutting, seaming, & gluing of a traditional application.

The stones/pavers, synthetic turf and paper template are all cut by waterjet, laser CNC machine, or other suitable means to match precisely and line up perfectly. The kit is easily installed by placing a pre-cut paper template 520 in place on prepared base. The template is not shown, but is similar in shape as the corresponding turf as in the other configurations. The template has cut-out spaces or voids which are numbered accordingly to the matching pre-cut stones or tiles. Next, the corresponding inserts/stones/pavers 540 (also numbered) are inserted into the appropriate matching spaces. Finally, the Pre-Cut Synthetic Turf 530 with matching cut-out voids is rolled out or unfolded on top of the corresponding inserts (stones/pavers) to form one planar surface. The Pre-Cut Kits can consist of standardized sizing (i.e.: 4'×8' sheet of plywood) or can be sized and cut to order per customer specifications and made of various shaped stones, patterns and turf choices (pile height, color, etc.) The turf is then infilled (sand) or fastened (staples/nails) if, or as, necessary by standard turf methods. Sections can be linked together to extend spaces as necessary.

The components of the Pre-Cut Free-Form Walk and Patio Kit Configuration 500 are as follows:

- Pre-Cut Paper Template 520, cut by plotter/cutter machine or hand
- Pre-Cut Inserts/Pavers/Stones or Tiles 540, cut by waterjet or laser CNC machine, or other suitable method
- Pre-Cut Turf Layer 530, cut by waterjet or laser CNC machine or other suitable method The method of assembly of the Pre-Cut Free-Form Walk and Patio Kit Configuration 500 is as follows:

1) Install Pre-Cut Paper Template on prepared base (insert voids are clearly marked via numbers/letters)
2—Install corresponding Pre-Cut Pavers/Stones or Tiles in insert openings (inserts are clearly marked via numbers/letters to correspond with the paper template voids)
3—Install unfold/unroll Pre-Cut Turf Layer over corresponding inserts Pavers/Stones from end to end or side to side. Note this step could be used in any of the above configurations.

The "Kit" Concepts

Under one aspect of the present invention, "kits" can be provided for sale online, at home improvement stores or the like. These kits can correspond to each configuration disclosed herein.

For configuration 100, the kit would include the Pre-Cut Turf Layer 130. Instructions would also be provided to facilitate the matching of this kit with suitably sized inserts 140, sold separately. Installation order would be to unfold/unroll the Pre-Cut Turf Layer 130 and place on prepared surface. Then the corresponding inserts 140 would be installed into the voids to create a planar surface.

For configuration 200, the kit would include the Pre-Cut Paper Template 220 and the Pre-Cut Turf Layer 230, together and sold as a kit. Instructions would also be provided to facilitate the matching of this kit with suitably sized inserts 240, sold separately. Installation order would be installation of the paper template, then inserts, then turf.

For configuration 300, the kit would include the Pre-Cut Foam Template 320 and the Pre-Cut Turf Layer 330, together and sold as a kit. Instructions would also be provided to facilitate the matching of this kit with suitably sized inserts 340, sold separately. Installation order would be installation of the foam template, then inserts, then turf.

For configuration 400, the interlocking foam template 420 could be substituted for the Pre-Cut Foam Template 320 of configuration 300, and the kit would be the interlocking foam template 420 and the Pre-Cut Turf Layer 330, together and sold as a kit. Installation order would be installation of the foam template, then inserts, then turf.

For configuration 500, it may be understood that a kit similar to either configurations 100, 200, or 300 could be provided; the only difference would be that a free form design is used as opposed to a grid pattern. The inserts would in one configuration be cut by machine to match the free form voids.

Materials

The turf could be made of any suitable turfs, imitation grasses, or suitable walking surface materials. Likewise, the paper template could be craft paper, cardboard, or degradable plastic. Cork or thin degradable plastics could also be used for the paper template. The foam template could also be solid, expanded or cross-linked polyethylene foam, PVC, or the like. The inserts could also be payers, stones, tiles, wood, cork, or any solid elements suitable for exterior use.

Further Alternates

Additional alternate or separate inventions may also be provided. One such concept includes varying the original manufacture of the turf before voids are cut into it. Instead of the turf coming off of the machines as a full solid carpet (solid backing and solid full fibers, it would still come off in a solid sheet of backing, but the yarn or turf fibers would only be stitched in the pre-determined grid patterns, leaving "bare" areas corresponding to insert sizes. The bare insert backing shape could then be removed at factory or even later onsite before install, or maybe even the voids are not cut out, and the inserts placed into the upwardly facing cavity atop the "bare" areas. Any of these configurations could be said to provide a pre-formed turf grid layer into which inserts may be placed.

It should also be understood that this configuration could also be used inside, outside, horizontal and even on vertical walls/spaces, and should not be so limited.

It should also be understood that the pre-formed turf grid can be manufactured at a central location, and then sold with instructions so as to provide installation at multiple consumer home or retail business locations. In the case multiple pre-formed turf grid can be manufactured at a central, "first" location, and then the pre-formed turf grid can be sold with instructions so as to allow the buyer to then separately buy inserts and install them along with the turf grid at a location or the buyer's choice. Obviously, the purchase of the grids by multiple buyers can result in the manufacture of multiple grids at a "first" location, and then the installation of the grids at remote "second" and "third" locations. This can also apply to the templates; the purchase of the templates by multiple buyers can result in the manufacture of multiple templates at a "first" location, and then the installation of the templates (along with the grids) at remote "second" and "third" locations.

Further Comments

It should be understood that said pre-formed includes but is not limited to pre-cut. A void could be "pre-formed" in said turf layer by means other than cutting. For example, as the turf layer is being manufactured, the voids could be defined as noted above during the manufacturing process.

Note that under the lexicon of this application, a pre-formed turf layer should be interpreted to include a pre-cut turf layer (in which a turf layer is first manufactured, and then holes are cut in the turf layer either by hand or by machine such as a water-jet cutting process) as well as a pre-formed turf layer in which the voids in the turf layer are provided during the manufacturing process (e.g., during the tufting and backing process).

Figure 33:
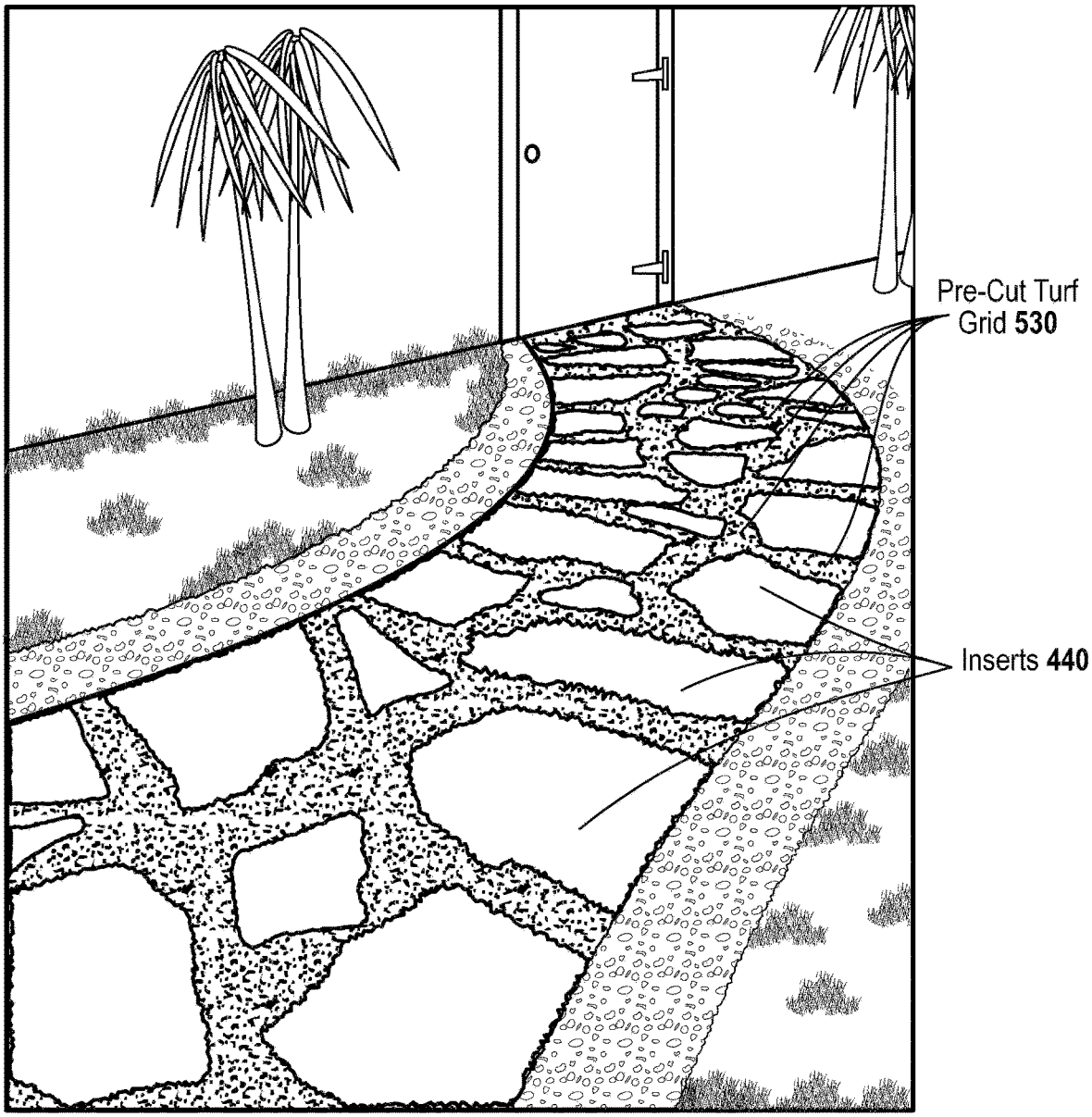
FIG. 33 shows a configuration 500 which includes the use of a "free form" pre-cut turf layer 530, with corresponding pre-cut inserts 540.
Figure 34B:
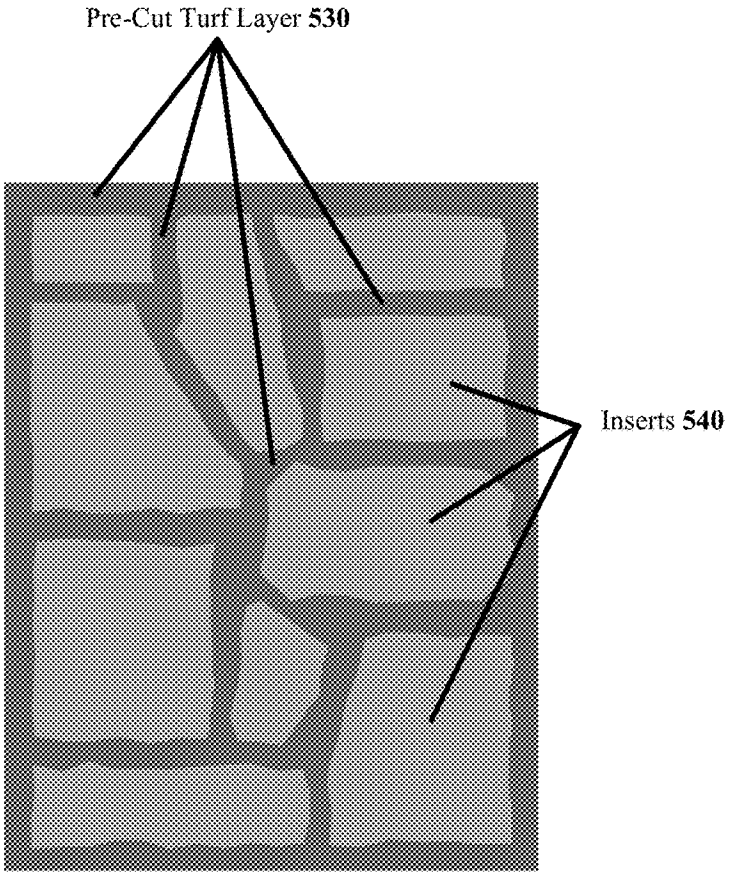
FIG. 34B shows pre-cut inserts 540 in place in the pre-cut turf layer 530.
Figure 34A:
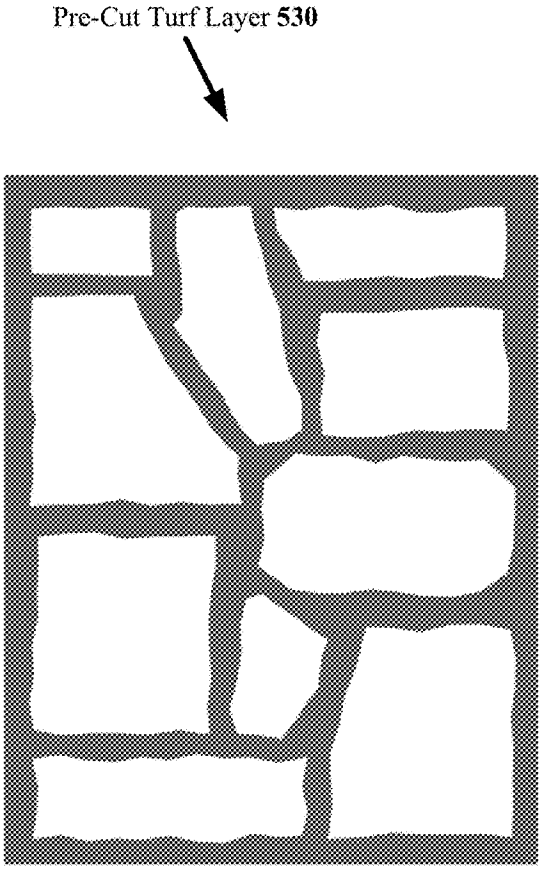
FIG. 34A shows a pre-cut turf layer 530.

Note that the term "turf grid" is intended to describe the general concept of a grid or web member which includes multiple voids therein. It may be understood that this general category includes a grid having a regular and repeating pattern (such as shown in FIGS. 1, 19, 26, and 31) as well as a grid which is more "free-form", with non-rectangular voids such as shown in FIGS. 33. 34A, and 34B) which may include nonlinear borders between the grid body and the voids therein, and/or voids having a non-rectangular periphery.

CONCLUSION

Various modifications and variations can be made in the present invention without departing from the spirit or scope of the invention.

From the foregoing, it will be seen that this invention is one well adapted to obtain all the ends and objects herein set forth, together with other advantages which are obvious, and which are inherent to the structure.

It will be understood that certain features and sub combinations are of utility and may be employed without reference to other features and sub combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method of assembling a synthetic turf system configured for placement atop a supporting sub-base so as to provide a decorative and functional walking surface, said method comprising the steps of:

A) positioning a layer of synthetic turf layer at a first location;

B) while said layer of synthetic turf is positioned at said first location, cutting said synthetic turf layer so as to provide at least two spaced apart voids formed therein, such that a layer of pre-formed turf grid is provided having at least two spaced apart voids defined therein each of which extends completely through said turf grid layer;

C) transporting said section of pre-formed turf grid to a second location where a supporting sub-base is located, said second location being remote from said first location;

D) positioning a section of pre-formed template layer atop said supporting sub-base, said pre-formed template layer including having at least two spaced apart voids defined therein and extending completely through said template layer, said outer peripheries of said two spaced apart voids of said template layer being similar in shape and relative position as said two spaced apart voids of said pre-formed turf grid;

E) with the aid of said pre-formed template layer, positioning at least two inserts within said pre-formed template layer such that the outer peripheries of said two inserts correspondingly fit within said two spaced apart voids within said section of said pre-formed template layer, and said two inserts are positioned atop said supporting sub-base; and F) positioning said layer of pre-formed turf grid overlaid atop said pre-formed template layer, such that said two inserts correspondingly fit within said two spaced apart voids within said section of pre-formed turf grid as it is lowered in place, and such that when in place said section of said pre-formed turf grid and said two inserts combine to provide said decorative and functional walking surface.

2. The method as claimed in claim 1, wherein said pre-formed turf grid and said pre-formed template layer are both manufactured at said first location, and transported together to said second location.

3. The method as claimed in claim 1, wherein said pre-formed template layer is paper.

4. The method as claimed in claim 1, wherein said pre-formed template layer is foam.

5. A method of assembling a synthetic turf system configured for placement atop a supporting sub-base so as to provide a decorative and functional walking surface, said method comprising the steps of:

A) positioning a layer of synthetic turf layer at a first location;

B) while said layer of synthetic turf is positioned at said first location, cutting said synthetic turf layer so as to provide at least two spaced apart voids formed therein, such that a layer of pre-formed turf grid is provided having at least two spaced apart voids defined therein each of which extends completely through said turf grid layer;

C) transporting said section of pre-formed turf grid to a second location where a supporting sub-base is located, said second location being remote from said first location;

D) assembling a pre-formed template layer of multiple sections and positioning said assembled template layer atop said supporting sub-base, said pre-formed template layer including having at least two spaced apart voids defined therein and extending completely through said template layer, said outer peripheries of said two spaced apart voids of said template layer being similar in shape and relative position as said two spaced apart voids of said pre-formed turf grid;

E) with the aid of said pre-formed template layer, positioning at least two inserts within said pre-formed template layer such that the outer peripheries of said two inserts correspondingly fit within said two spaced apart voids within said section of said pre-formed template layer, and said two inserts are positioned atop said supporting sub-base; and F) positioning said layer of pre-formed turf grid overlaid atop said pre-formed template layer, such that said two inserts correspondingly fit within said two spaced apart voids within said section of pre-formed turf grid as it is lowered in place, and such that when in place said section of said pre-formed turf grid and said two inserts combine to provide said decorative and functional walking surface.

6. The method of claim 5, wherein said pre-formed template layer of multiple sections includes multiple interlocking members.

* * * * *